US011191405B2

(12) United States Patent
Iwakami et al.

(10) Patent No.: US 11,191,405 B2
(45) Date of Patent: Dec. 7, 2021

(54) VACUUM CLEANER

(71) Applicant: MAKITA CORPORATION, Anjo (JP)

(72) Inventors: Junichi Iwakami, Anjo (JP); Takayuki Tahara, Anjo (JP)

(73) Assignee: MAKITA CORPORATION, Anjo (JP)

( * ) Notice: Subject to any disclaimer, the term of this patent is extended or adjusted under 35 U.S.C. 154(b) by 93 days.

(21) Appl. No.: 16/782,217

(22) Filed: Feb. 5, 2020

(65) Prior Publication Data

US 2020/0245835 A1 Aug. 6, 2020

(30) Foreign Application Priority Data

Feb. 6, 2019 (JP) ..... JP2019-019872

(51) Int. Cl.
*A47L 9/22* (2006.01)
*A47L 5/24* (2006.01)
*A47L 9/28* (2006.01)

(52) U.S. Cl.
CPC ..... *A47L 9/22* (2013.01); *A47L 5/24* (2013.01); *A47L 9/2884* (2013.01)

(58) Field of Classification Search
CPC . A47L 9/22; A47L 5/24; A47L 9/2884; A47L 9/00; A47L 9/0081; A47L 11/4097; D06N 2209/025; Y10T 74/19907
USPC ..... 15/326
See application file for complete search history.

(56) References Cited

U.S. PATENT DOCUMENTS

| | | | | |
|---|---|---|---|---|
| 3,328,820 | A | 7/1967 | Doersam | |
| 4,334,337 | A * | 6/1982 | Miller | A47L 7/0009 15/326 |
| 4,586,214 | A * | 5/1986 | Berfield | A47L 5/362 15/327.2 |
| 4,594,807 | A | 6/1986 | McQueen | |
| 5,109,566 | A | 5/1992 | Kobayashi et al. | |
| 5,274,878 | A | 1/1994 | Radabaugh et al. | |
| 5,995,884 | A | 11/1999 | Allen et al. | |
| 6,151,749 | A | 11/2000 | Berfield | |
| 6,295,692 | B1 | 10/2001 | Shideler | |
| 6,553,612 | B1 | 4/2003 | Dyson et al. | |
| 6,568,026 | B2 | 5/2003 | Roy et al. | |
| 6,581,239 | B1 | 6/2003 | Dyson et al. | |

(Continued)

FOREIGN PATENT DOCUMENTS

| | | |
|---|---|---|
| DE | 1428497 A1 | 3/1969 |
| DE | 69910252 T2 | 7/2004 |

(Continued)

OTHER PUBLICATIONS

WO 2016054947A1 specification, Espacenet (Year: 2021).*

*Primary Examiner* — Joseph J Hail
*Assistant Examiner* — Timothy Brady
(74) *Attorney, Agent, or Firm* — J-TEK Law PLLC; Jeffrey D. Tekanic; Scott T. Wakeman

(57) ABSTRACT

A vacuum cleaner (1; 1B) includes a housing (2; 100) that houses a fan (7) and a motor (8), which generates power that rotates the fan (7); one or more air-exhaust ports (10), which is provided in at least a portion of the housing (2; 100); and a sound-absorbing member (33) having a through hole (33). The sound-absorbing member (33) is disposed in an interior space of the housing (2; 100) so as to face the air-exhaust port(s) (10).

20 Claims, 18 Drawing Sheets

(56) References Cited

U.S. PATENT DOCUMENTS

| | | | | |
|---|---|---|---|---|
| 7,492,124 | B2 | 2/2009 | Johnson et al. | |
| 7,769,490 | B2 | 8/2010 | Abramson et al. | |
| 8,354,183 | B2 | 1/2013 | Konuma et al. | |
| 8,733,470 | B2 | 5/2014 | Matthias et al. | |
| 8,842,427 | B2 | 9/2014 | Yoshimura et al. | |
| 9,456,722 | B2 | 10/2016 | Tomasiak et al. | |
| 9,532,688 | B1 | 1/2017 | Afrouzi et al. | |
| 2003/0060928 | A1 | 3/2003 | Abramson et al. | |
| 2004/0078116 | A1 | 4/2004 | Hashimoto et al. | |
| 2005/0155177 | A1 | 7/2005 | Baer et al. | |
| 2006/0005346 | A1 | 1/2006 | Rupp et al. | |
| 2007/0174992 | A1* | 8/2007 | Murray | A47L 9/0081 15/326 |
| 2008/0052867 | A1 | 3/2008 | Park | |
| 2008/0062618 | A1 | 3/2008 | Frank et al. | |
| 2008/0276407 | A1 | 11/2008 | Schnittman et al. | |
| 2008/0281470 | A1 | 11/2008 | Gilbert et al. | |
| 2009/0307865 | A1 | 12/2009 | Williamson et al. | |
| 2010/0062326 | A1 | 3/2010 | Konuma et al. | |
| 2010/0088843 | A1 | 4/2010 | Reed et al. | |
| 2010/0163167 | A1* | 7/2010 | Maheshwari | B29C 70/549 156/245 |
| 2010/0332067 | A1 | 12/2010 | Abramson | |
| 2011/0031059 | A1* | 2/2011 | Parish | A61F 11/08 181/129 |
| 2012/0011668 | A1 | 1/2012 | Schnittman et al. | |
| 2012/0112689 | A1 | 5/2012 | Sever et al. | |
| 2012/0251229 | A1 | 10/2012 | Liang et al. | |
| 2012/0265343 | A1 | 10/2012 | Gilbert et al. | |
| 2013/0117952 | A1 | 5/2013 | Schnittman et al. | |
| 2014/0079973 | A1 | 3/2014 | Liang et al. | |
| 2014/0151079 | A1 | 6/2014 | Furui et al. | |
| 2014/0159919 | A1 | 6/2014 | Furui et al. | |
| 2014/0304939 | A1 | 10/2014 | Suzuki | |
| 2015/0214758 | A1 | 7/2015 | Toya et al. | |
| 2015/0223652 | A1* | 8/2015 | Koura | A47L 9/32 15/327.2 |
| 2015/0366133 | A1 | 12/2015 | Nojiri et al. | |
| 2016/0095487 | A1 | 4/2016 | Koura et al. | |
| 2016/0151846 | A1 | 6/2016 | Suzuki | |
| 2016/0175895 | A1 | 6/2016 | Suzuki | |
| 2016/0293912 | A1 | 10/2016 | Manion et al. | |
| 2017/0007085 | A1 | 1/2017 | Tahara | |
| 2017/0044761 | A1* | 2/2017 | Flotre | G10K 11/162 |
| 2017/0193761 | A1 | 7/2017 | Suzuki | |
| 2018/0126534 | A1 | 5/2018 | Iida et al. | |
| 2018/0126537 | A1 | 5/2018 | Tanaka et al. | |
| 2018/0229317 | A1 | 8/2018 | Suzuki | |
| 2018/0365962 | A1 | 12/2018 | Kusakawa et al. | |
| 2019/0022775 | A1 | 1/2019 | Suzuki | |
| 2020/0234686 | A1* | 7/2020 | Hosoda | B32B 27/304 |

FOREIGN PATENT DOCUMENTS

| | | | |
|---|---|---|---|
| DE | 102005007923 | A1 | 8/2006 |
| DE | 102010043582 | A1 | 5/2012 |
| DE | 102011004319 | A1 | 8/2012 |
| GB | 1027111 | A | 4/1966 |
| JP | S63311923 | A | 12/1988 |
| JP | H02241423 | A | 9/1990 |
| JP | H0453515 | A | 2/1992 |
| JP | H0588472 | U | 12/1993 |
| JP | H0670872 | A | 3/1994 |
| JP | H0751200 | A | 2/1995 |
| JP | H11285158 | A | 10/1999 |
| JP | 2001137158 | A | 5/2001 |
| JP | 2001169974 | A | 6/2001 |
| JP | 2002224631 | A | 8/2002 |
| JP | 2002532178 | A | 10/2002 |
| JP | 2002320573 | A | 11/2002 |
| JP | 2002320579 | A | 11/2002 |
| JP | 2002360479 | A | 12/2002 |
| JP | 2002360480 | A | 12/2002 |
| JP | 2005313657 | A | 11/2005 |
| JP | 2006043302 | A | 2/2006 |
| JP | 2006305248 | A | 11/2006 |
| JP | 2008036723 | A | 2/2008 |
| JP | 2008061674 | A | 3/2008 |
| JP | 2008155041 | A | 7/2008 |
| JP | 2010178773 | A | 8/2010 |
| JP | 2011244724 | A | 12/2011 |
| JP | 2011244780 | A | 12/2011 |
| JP | 4955332 | B2 | 6/2012 |
| JP | 2013192867 | A | 9/2013 |
| JP | 2013239259 | A | 11/2013 |
| JP | 2014008303 | A | 1/2014 |
| JP | 2014030484 | A | 2/2014 |
| JP | 2014036750 | A | 2/2014 |
| JP | 2014083241 | A | 5/2014 |
| JP | 2014111190 | A | 6/2014 |
| JP | 2014147904 | A | 8/2014 |
| JP | 2014155862 | A | 8/2014 |
| JP | 2014180501 | A | 9/2014 |
| JP | 2015084810 | A | 5/2015 |
| JP | 2015091500 | A | 5/2015 |
| JP | 2018007849 | A | 1/2018 |
| WO | 00/36962 | A1 | 6/2000 |
| WO | 00/38255 | A1 | 6/2000 |
| WO | 2011115121 | A1 | 9/2011 |
| WO | 2013065390 | A1 | 5/2013 |
| WO | 2014021116 | A1 | 2/2014 |
| WO | 2014119160 | A1 | 8/2014 |
| WO | 2014119732 | A1 | 8/2014 |
| WO | 2014155904 | A1 | 10/2014 |
| WO | WO 2016054947 | A1 * | 4/2016 |

* cited by examiner

VACUUM CLEANER

CROSS-REFERENCE

The present application claims priority to Japanese patent application serial number 2019-019872 filed on Feb. 6, 2019, the contents of which are incorporated fully herein by reference.

TECHNICAL FIELD

The present invention relates to a vacuum cleaner that is preferably cordless (i.e. powered by a rechargeable battery).

BACKGROUND ART

As is disclosed, e.g., in Japanese Laid-open Patent Application 2008-061674, known vacuum cleaners comprise a motor that generates power to rotate a fan. When the fan rotates, air is sucked in, together with dust, debris, etc., via suction ports of the vacuum cleaner. The air sucked in via the suction ports circulates (passes) through an interior space of the vacuum cleaner, which contains a dust filter, and then the filtered air is exhausted via air-exhaust ports.

SUMMARY OF THE INVENTION

However, when the fan rotates, it generates noise, which is unpleasant for the user.

It is therefore one non-limiting object of the present invention to reduce the noise level (output) of a vacuum cleaner.

According to one aspect of the present teachings, a vacuum cleaner, such as a handheld (cordless) vacuum cleaner, may comprise: a housing that houses a fan and a motor, which generates power that rotates the fan; one or more air-exhaust ports provided in at least a portion of the housing; and at least one sound-absorbing member having one or more through holes. The at least one sound-absorbing member is disposed in an interior space of the housing so as to face (oppose) the air-exhaust port(s).

In this aspect of the present teachings, the noise level experienced by the user can be reduced. Additional aspects, objects, embodiments and advantages of the present teachings will become apparent upon reading the following detailed description in view of the appended drawings and claims.

DETAILED DESCRIPTION OF THE PREFERRED EMBODIMENTS

Although embodiments according to the present teachings will be explained below with reference to the drawings, the present invention is not limited to these embodiments.

In the present embodiments, an XYZ orthogonal coordinate system is prescribed and positional relationships between elements will be described with reference to the XYZ orthogonal coordinate system. The direction parallel to the X axis within a prescribed plane is the X-axis direction. The direction parallel to the Y axis within the prescribed plane, which is orthogonal to the X axis, is the Y-axis direction. The direction parallel to the Z axis, which is orthogonal to the prescribed plane, is the Z-axis direction. The X-axis direction is a front-rear direction. The Y-axis direction is a left-right direction. The Z-axis direction is an up-down direction. The +X direction is forward, and the −X direction is rearward. The +Y direction is leftward, and the −Y direction is rightward. The +Z direction is upward, and the −Z direction is downward.

Figure 1:
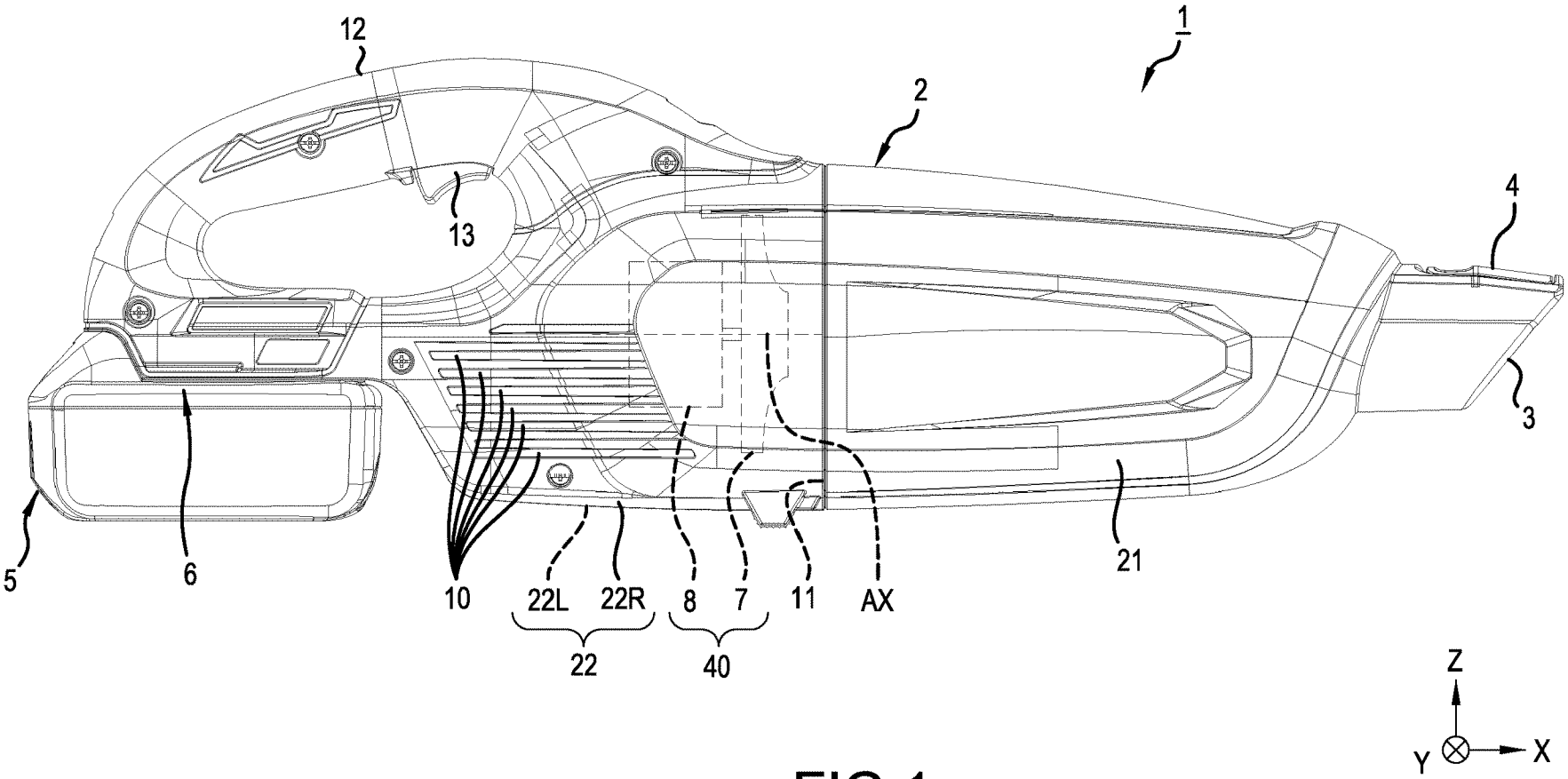
FIG. 1 is a side view of a handheld vacuum cleaner according to a first embodiment of the present teachings.

Overview of a Representative Handheld Vacuum Cleaner According to the Present Teachings FIG. 1 is a side view of a handheld vacuum cleaner 1 according to a first embodiment of the present teachings. As shown in FIG. 1, the handheld vacuum cleaner 1 comprises: a housing 2, which has a suction port 3 and air-exhaust ports 10; a battery-mounting part 6, on which a battery (battery pack, battery cartridge) 5 for a power tool is mounted; and a drive unit 40 comprising a fan 7 and a motor 8, which generates power that rotates the fan 7.

The housing 2 houses the drive unit 40, which comprises the fan 7 and the motor 8. The housing 2 comprises: a front housing 21, which has the suction port 3 defined therein; and a rear housing 22, which has the air-exhaust ports 10 defined therein. Air, together with dust, debris, etc., proximal to the suction port 3 of the housing 2 is sucked in via the suction port 3. The air, dust, etc. sucked in via the suction port 3 circulates (passes) through an interior space of the housing 2 to filter it (see below) and the filtered air is then exhausted via the air-exhaust ports 10 to the exterior of the housing 2. The front housing 21 comprises a suction-nozzle portion 4, which has a tube shape that defines the suction port 3. The air-exhaust ports 10 are provided in at least a portion of the rear housing 22, e.g., in side surfaces of the rear housing 22 in the Y-axis direction.

The front housing 21 has an opening 11, into which at least a portion of the rear housing 22 is inserted. That is, a front part of the rear housing 22 is inserted into the opening 11, which is provided in a rear part of the front housing 21, to connect the front housing 21 with the rear housing 22 in an attachable and detachable manner.

The rear housing 22 comprises a left housing 22L connected with a right housing 22R. The left housing 22L and the right housing 22R are fixed to one another by one or more fasteners, such as one or more screws.

The rear housing 22 comprises a handle 12 configured to be held by a user of the handheld vacuum cleaner 1. A trigger switch 13 is provided on the handle 12. The trigger switch 13 is configured to be pulled (manipulated) by the user while holding the handle 12 in one hand. When the trigger switch 13 is pulled, the motor 8 is driven. When the pulling of the trigger switch 13 is released, the motor 8 stops.

The user pulls the trigger switch 13 while holding the handle 12 to perform cleaning work. The handheld vacuum cleaner 1 is a handy vacuum cleaner that is capable of being held in one hand while performing cleaning work.

The battery 5 for a power tool is mounted on the battery-mounting part 6. The motor 8 is driven by electric power supplied from the battery 5. The battery-mounting part 6 is disposed on a lower part of the handle 12. The battery 5 is preferably designed as a rechargeable battery pack (battery cartridge) that is usable in an interchangeable manner with other types of power tools, such as driver-drills, circular saws, etc. The battery 5 preferably contains a plurality of battery cells connected in series, such as lithium ion battery cells (although the battery chemistry is not particularly limited in the present teachings), and may have a nominal output voltage between, e.g., 10-60 volts, such as 18 volts, 24 volts, 36 volts, etc. The battery capacity may be, e.g., 1 to 5 amp-hours.

The battery-mounting part 6 preferably comprises: a pair of guide rails, which guide the battery 5; and connection terminals, which are disposed between the pair of guide rails. The connection terminals comprise plus and minus terminals for electrically connecting to corresponding terminals of the battery 5, as well as optionally one or more connection terminals for electrically connecting to a controller and/or a temperature sensor and/or a voltage sensor disposed in the battery 5.

As was noted above, the battery 5 is preferably a rechargeable-type battery. The battery 5 comprises: a pair of slide rails that correspond (are complimentary) to the guide rails of the battery-mounting part 6; plus and minus battery terminals, which are disposed between the pair of slide rails in correspondence with the plus and minus terminals of the battery-mounting part 6, and optionally one or more terminals that electrically communicate signals from/to a controller and/or a temperature sensor and/or a voltage sensor disposed in the battery 5.

When the battery 5 is to be mounted on the battery-mounting part 6, the user slides the battery 5 forward while guiding the slide rails of the battery 5 on the guide rails of the battery-mounting part 6. When the battery 5 has been completely slid forward, the battery 5 and the battery-mounting part 6 are fixed to one another, and the terminals of the battery 5 are electrically connected with the corresponding terminals of the battery-mounting part 6. Thereby, the battery 5 is mounted on the battery-mounting part 6.

When the battery 5 is to be removed from the battery-mounting part 6, the user manipulates (presses) a button provided on the battery 5, which latches the battery 5 to the battery-mounting part 6, in order to release the latching. Thus, when the button is pressed, the battery 5 is no longer latched to the battery-mounting part 6 and thus the battery 5 may be slid rearward to be removed from the battery-mounting part 6.

Figure 2:
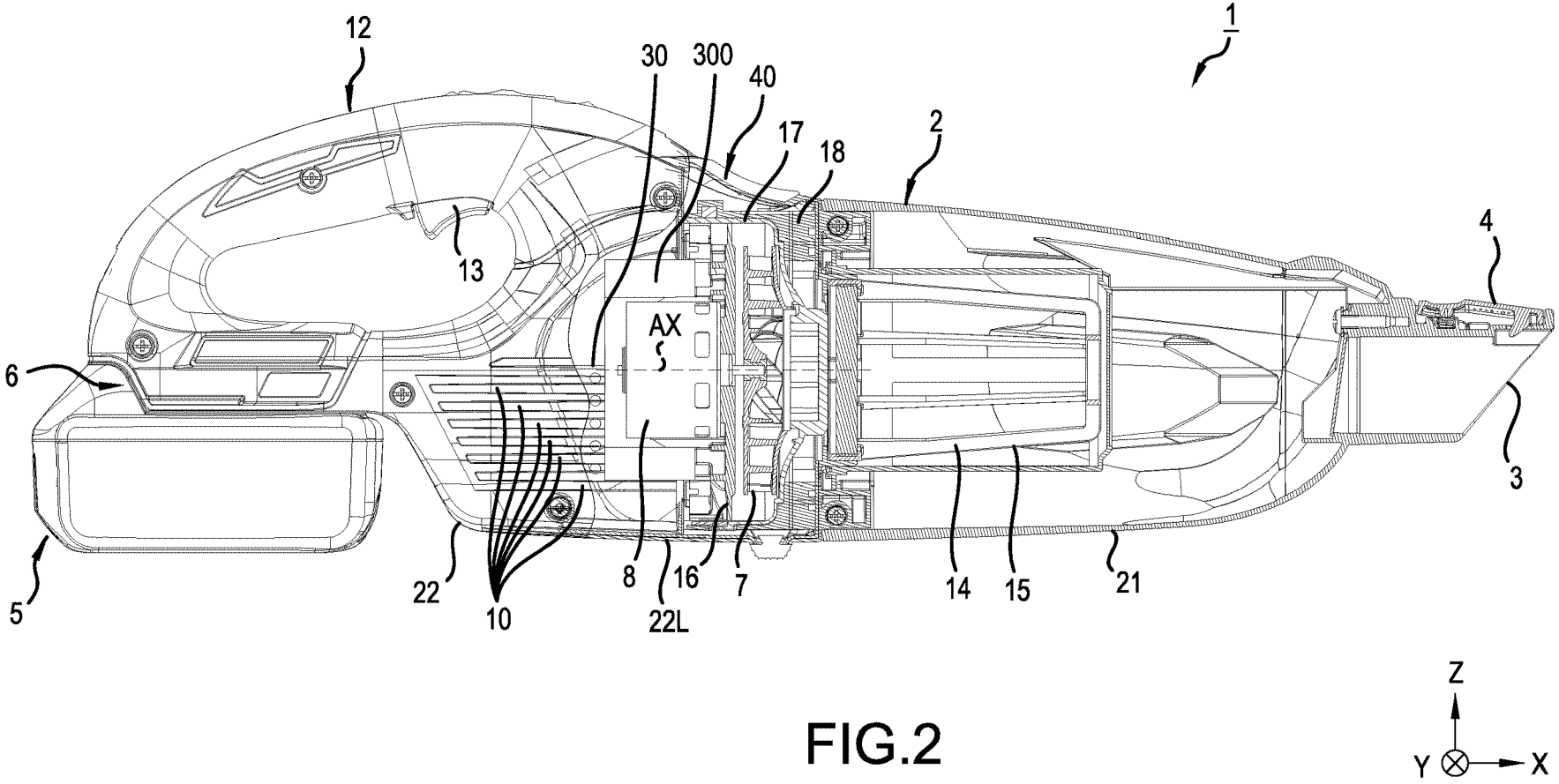
FIG. 2 is a partial, broken view of the handheld vacuum cleaner according to the first embodiment.

FIG. 2 is a partial, broken view of the handheld vacuum cleaner 1 according to the first embodiment. As shown in FIG. 2, the handheld vacuum cleaner 1 comprises a plurality of resin (polymer, plastic) ribs 14 and a filter 15, which is disposed around the resin ribs 14. The resin ribs 14 support the filter 15. The resin ribs 14 and the filter 15 are disposed in the interior space of the front housing 21 between the suction port 3 and the fan 7.

The drive unit 40 comprises: the fan 7, which is capable of rotating about rotary shaft AX that extends parallel to the X axis; the motor 8, which generates the power that rotates the fan 7; a motor base 16, which supports the motor 8; and a fan cover 17, which houses the fan 7 and the motor base 16. At least a portion of the fan cover 17 is covered by a rubber vibration isolator 18, as will be further described below. The drive unit 40 is disposed in the interior space of the rear housing 22.

When the fan 7 is rotated about rotary shaft AX, a suction force is generated at the suction port 3. The motor 8 generates the power that rotates the fan 7 about rotary shaft AX.

The motor base 16 is disposed around the motor 8 and is fixed to the motor 8.

The fan cover 17 is disposed around the fan 7 and the motor base 16 and is fixed to the motor base 16. The motor base 16 is fixed to the rear housing 22 via the fan cover 17. The motor 8 is fixed to the rear housing 22 via the motor base 16 and the fan cover 17. The fan 7 rotates in the interior of the fan cover 17.

The rubber vibration isolator 18 covers at least a portion of the fan cover 17. Preferably, at least a portion of the rubber vibration isolator 18 is disposed between the fan cover 17 and the rear housing 22 such that it contacts both the fan cover 17 and the rear housing 22. The rubber vibration isolator 18 reduces (absorbs, attenuates) the transmission of vibration, which is generated by the motor 8, to the rear housing 22. Further details concerning the rubber vibration isolator 18 are provided below.

The air-exhaust ports 10 are provided in both the left housing 22L and the right housing 22R. The air-exhaust ports 10 are provided in both the side surface of the rear housing 22 on the +Y side and the side surface of the rear housing 22 on the −Y side. The air-exhaust ports 10 provide fluid communication between the interior space of the rear housing 22 and the exterior thereof.

As was noted above, when the trigger switch 13 is pulled and the motor 8 is driven, the fan 7 rotates and a suction force is thereby generated at the suction port 3. Consequently, air, dust, debris, etc. proximal to the suction port 3 is (are) suctioned into the interior space of the front housing 21 of the housing 2. The air that flows into the interior space of the front housing 21 passes through the filter 15, whereby the filter 15 collects (filters) the dust, etc. contained in the air. The air that passes through the filter 15 passes through the drive unit 40, which comprises the fan 7 and the motor 8, and then is exhausted to the exterior of the housing 2 via the air-exhaust ports 10.

Sound-Absorbing Member

The handheld vacuum cleaner 1 comprises a sound-absorbing member 30, which is disposed in the interior space of the rear housing 22 such that it faces the air-exhaust ports 10. The sound-absorbing member 30 is a porous member having open cells (open pores), and preferably has a network of interconnected cells/pores. The sound-absorbing member 30 absorbs (attenuates) sound that propagates through the exhaust air and thereby reduces the noise level of the vacuum cleaner 1 during operation. Examples of noise generated by the handheld vacuum cleaner 1 include wind noise, which is generated by the circulation of air in the interior space of the housing 2, and fan noise, which is generated by the rotation of the fan 7.

Generally speaking, it is noted that sound absorption and exhaust resistance (suction power) are in a trade-off relationship. In other words, increasing the sound absorbing coefficient may cause the exhaust resistance (suction power) to decrease and vice versa. Therefore, the number, size, arrangement, etc. of through holes 33 in the sound-absorbing member 30 may be set based upon the requirements, design preferences, etc. of a particular application of the present teachings.

With this consideration in mind, the following principles are provided. Generally speaking, the sound absorption coefficient may be increased by: (i) decreasing smaller the diameter(s) of the through holes, (ii) decreasing the ratio of the surface area of the through hole(s) to the total area of the sound-absorbing member 30, (iii) increasing the distance between the through holes, (iv) increasing the thickness of the sound-absorbing member 30. In principle, the higher the sound-absorbing coefficient, the better, as long as exhaust resistance is not increased to the point of detrimentally affecting the suction power of the vacuum cleaner 1. It is noted that the through holes are not required to have the same diameter. For example, if two different sound-absorption coefficient peaks are desired (because it is desired to attenuate sounds having two different wavelengths (e.g., wind noise and motor noise), then two or more sets of through holes, which each have different diameters, may be provided in the sound-absorbing member 30 to respectively better attenuate the two or more different peak sound wavelengths.

Figure 3:
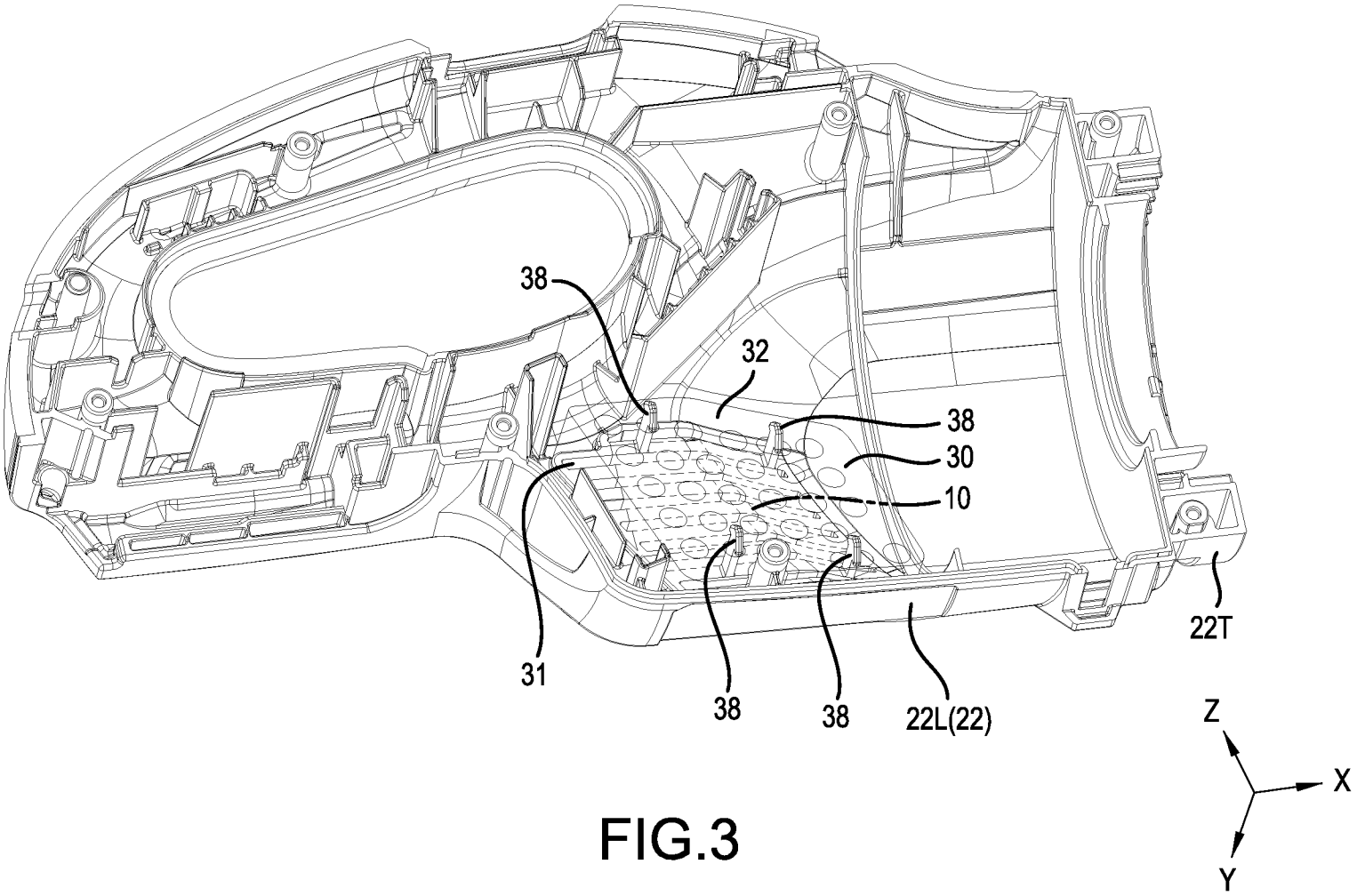
FIG. 3 is an oblique view of a sound-absorbing member, which is provided on a left housing, according to the first embodiment.
Figure 4:
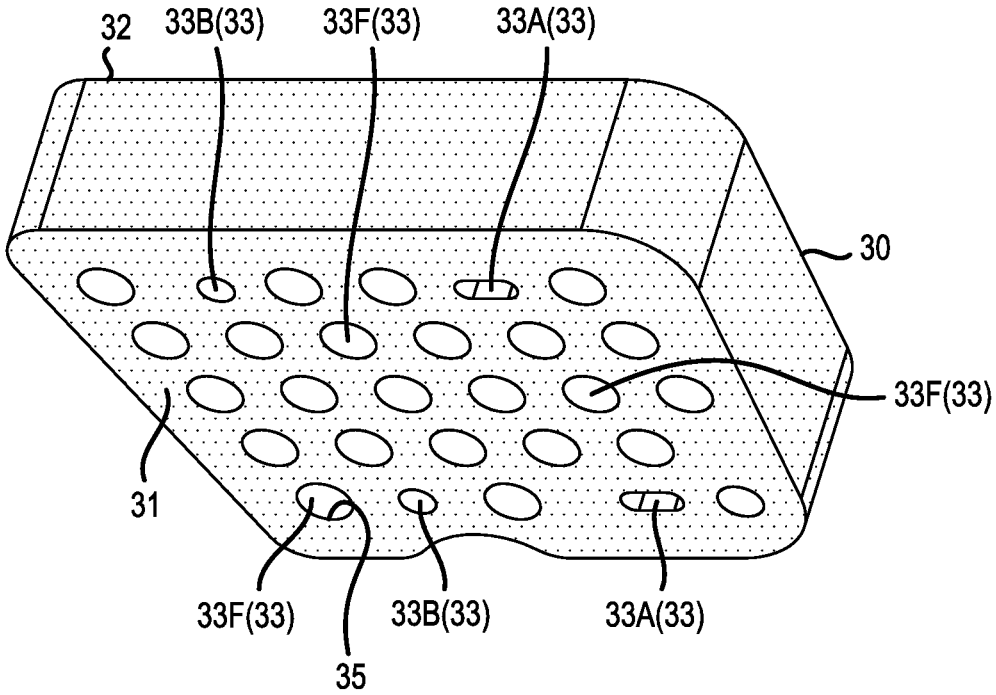
FIG. 4 is an oblique view of the sound-absorbing member according to the first embodiment.
Figure 5:
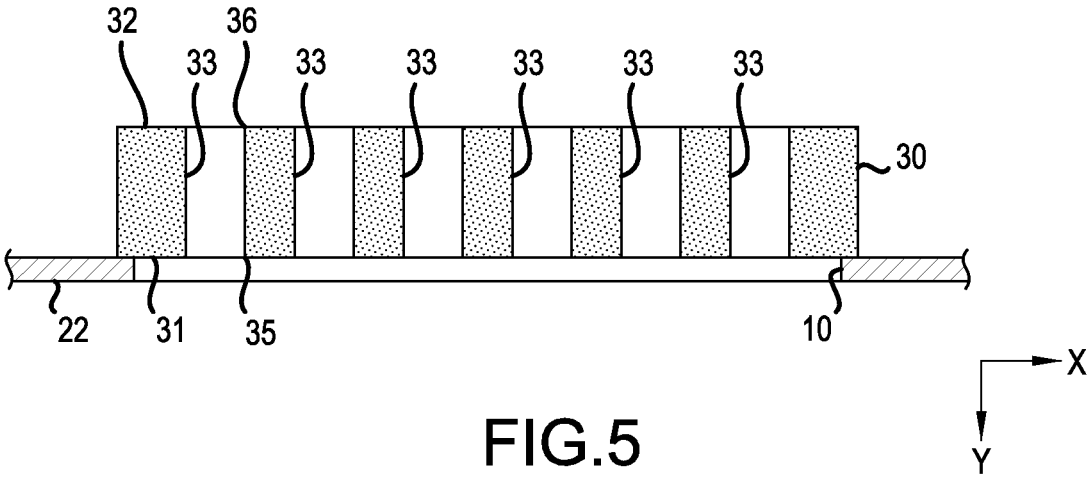
FIG. 5 is a cross-sectional view of the sound-absorbing member according to the first embodiment.

FIG. 3 is an oblique view of the sound-absorbing member 30 of the first embodiment, which is provided (disposed) in the left housing 22L. FIG. 4 is an oblique view of the sound-absorbing member 30. FIG. 5 is a cross-sectional view of the sound-absorbing member 30.

As shown in FIGS. 3-5, the sound-absorbing member 30 has: a first surface 31; a second surface 32, which faces the direction opposite that of the first surface 31; and through holes 33, which extend all the way through the body of the sound-absorbing member 30 from the first surface 31 to the second surface 32. A first opening 35 at one end of each through hole 33 is disposed in (at) the first surface 31. A second opening 36 at the other end of each through hole 33 is disposed in (at) the second surface 32. The sound-absorbing member 30 is disposed in the interior space of the rear housing 22 such that at least a portion of each first opening 35 faces the air-exhaust ports 10 and such that the second openings 36 face the center of the interior space of the rear housing 22.

A plurality of the through holes 33 is provided in the sound-absorbing member 30. The through holes 33 are (extend) substantially parallel to one another. Preferably, the through holes 33 extend perpendicular or substantially perpendicular (within a range of, e.g., 80-100°) with respect to the first surface 31.

Some of the through holes 33 (in particular, through holes 33F) are designed to permit the air that has passed through the filter 15 to be exhausted to the exterior of the housing 2. Such through holes 33 (33F) may have a circular cylindrical shape or another type of cylindrical shape (e.g., oval or elliptic cylindrical), such as a right cylindrical shape. However, through holes 33 (33F) having oblique cylindrical shapes may be used in some applications of the present teachings.

In the alternative, such through holes 33 (33F) may have an n-sided prism shape, in which n is any number greater than 3, or e.g., a star polygon cross-section. Such through holes 33 may be right prisms or oblique prisms. Of course, the through holes 33 need not be symmetrical about a longitudinal centerline, and thus cross-sectional shapes such as, e.g., half-moon, trapezoidal, semi-circular, etc. are also possible.

It is preferable that the through holes 33 (33F) intended to permit exhaust air to pass through are designed to permit/foster a laminar airflow in order to reduce air resistance, which could create turbulence and thus generate undesirable noise. Thus, it is preferable that the through holes 33 (33F) for exhausting air have a Reynolds number of less than 2300, more preferably less than 2000, even more preferably less than 1500. The cross-section of the through holes 33 (33F) is preferably constant or substantially constant (within a range of +/−5%) along the entire longitudinal length of the through holes 33 (33F) that is perpendicular to the plane of the first surface 31, in order to foster a laminar airflow.

The through holes 33F preferably have a diameter (or a widest dimension in the case of non-circular through holes) with a lower limit of greater than 1 mm, greater than 3 mm, greater than 5 mm or greater than 8 mm, and an upper limit of less than 20 mm, less than 17 mm, less than 15 mm, less than 12 mm, or less than 10 mm, or any range obtained by combining any of the preceding lower and upper limits without restriction.

The ratio of the surface area of the through holes 33F on the first surface 31 to the total area of the first surface 31 preferably has a lower limit of greater than 0.01, greater than 0.04, greater than 0.07 or greater than 0.10 and an upper limit of less than 0.30, less than 0.25, less than 0.20, or less than 0.15, or any range obtained by combining any of the preceding lower and upper limits without restriction.

As was mentioned above, the farther the through holes are spaced apart (i.e. the greater the distance between outer edges of adjacent through holes), the higher the sound absorbing effect is. Thus, the distance D between the edges of adjacent through holes 33 preferably has a lower limit of 1 mm or more, 3 mm or more, 5 mm or more, or 7 mm or more and an upper limit of 25 mm or less, 20 mm or less, 15 mm or less, or 10 mm or less, or any range obtained by combining any of the preceding lower and upper limits without restriction.

Figure 6:
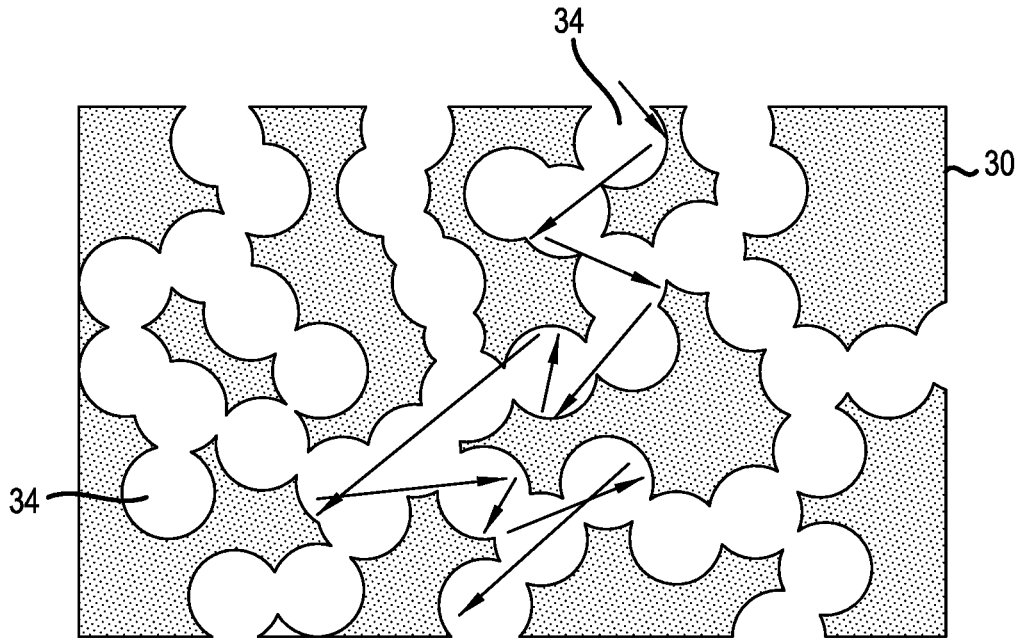
FIG. 6 is a partial, enlarged, schematic drawing of the sound-absorbing member according to the first embodiment.

FIG. 6 is a partial, enlarged, schematic drawing of the sound-absorbing member 30 according to the first embodiment. The sound-absorbing member 30 is a porous member having open cells (pores). More preferably, the sound-absorbing member 30 has numerous, minute cells 34. "Open cell" means that the cells (pores) 34 are connected to one another, i.e. a network of interconnected cells/pores is provided. The inner diameter of each through hole 33 is larger than the size (widest dimension in any direction) of one cell 34. Soft-urethane sponge (foam), polyester (foam), melamine sponges (foams), rubber sponges (foams), glass wool or other types of glass fiber mats, composite fiber non-woven materials, mineral wool and felt, and mixtures/combinations thereof, serve as examples of porous members having open cells that may be advantageously used with the present teachings.

If a foam or sponge material made of a polymer material (e.g., polyurethane, polyester, cellulose, etc.) is used as the sound-absorbing member 30, it is preferably that the foam/sponge material has a porosity with a lower limit of greater than 0.50, greater than 0.55, greater than 0.60, greater than 0.65 or greater than 0.70 and an upper limit of less than 0.95, less than 0.90, less than 0.85, less than 0.80 or less than 0.75 or any range obtained by combining any of the preceding lower and upper limits without restriction. Porosity is defined herein as meaning the ratio of the total volume of the voids (i.e. the volume of the cells or pores) in the foam or sponge material to the total volume of the foam or sponge material.

The cells or pores of the foam or sponge material preferably have a greatest pore dimension with a lower limit of greater than 50 μm, greater than 75 μm, greater than 100 μm or greater than 150 μm, and an upper limit of less than 500 μm, less than 400 μm, less than 300 μm, or less than 200 μm, or any range obtained by combining any of the preceding lower and upper limits without restriction.

If a wool, mat, felt or other nonwoven sheet material made of organic and/or inorganic fibers is used as the sound-absorbing member 30, the fibers preferably have a weight-average outer diameter with a lower limit of greater than 3 μm, greater than 5 μm, greater than 7 μm or greater than 9 μm, and an upper limit of less than 20 μm, less than 15 μm, less than 12 μm, or less than 10 μm, or any range obtained by combining any of the preceding lower and upper limits without restriction.

The fibers may be composite fibers that, e.g., have a sheath-core structure, in which a first material is the core and a second material is the sheath that surrounds the core. One or both of the composite materials may be organic, such as polypropylene, polyethylene terephthalate (PET), polyamine, etc. A mixture of organic and inorganic fibers may be used to make a nonwoven sheet. Such a sound-absorbing material preferably has an area (areal) density with a lower limit of greater than 100 g/m$^2$, greater than 150 g/m$^2$, greater than 200 g/m$^2$ or greater than greater than 250 g/m$^2$, and an upper limit of less than 700 g/m$^2$, less than 600 g/m$^2$, less than 500 g/m$^2$, or less than 450 g/m$^2$, or any range obtained by combining any of the preceding lower and upper limits without restriction.

The thickness of the sound-absorbing member 30 in the direction that the exhaust air passes through the through holes 33F preferably has a lower limit of greater than 5 mm, greater than 7 mm, greater than 9 mm or greater than 12 mm, and an upper limit of less than 30 mm, less than 25 mm, less than 22 mm, or less than 18 mm, or any range obtained by combining any of the preceding lower and upper limits without restriction.

A network of open cells exhibit a sound-absorbing capability for the following reason. Sound waves impinge on the cells 34 at the first surface 31 of the sound-absorbing member 30 and then propagate to adjacent cells 34 in the network of interconnected open cells 34 within the interior of the sound-absorbing member 30, thereby striking the inner surfaces of the cells 34. The sound waves either reflect off the inner surfaces of the cells 34 and propagates to other cells 34 or are absorbed by the sound-absorbing member 30 and dissipated as heat. Thus, the energy of the sound waves is attenuated by repeatedly striking the inner surfaces of the cells 34 or being absorbed, thereby reducing the noise level heard by the user.

Figure 7:
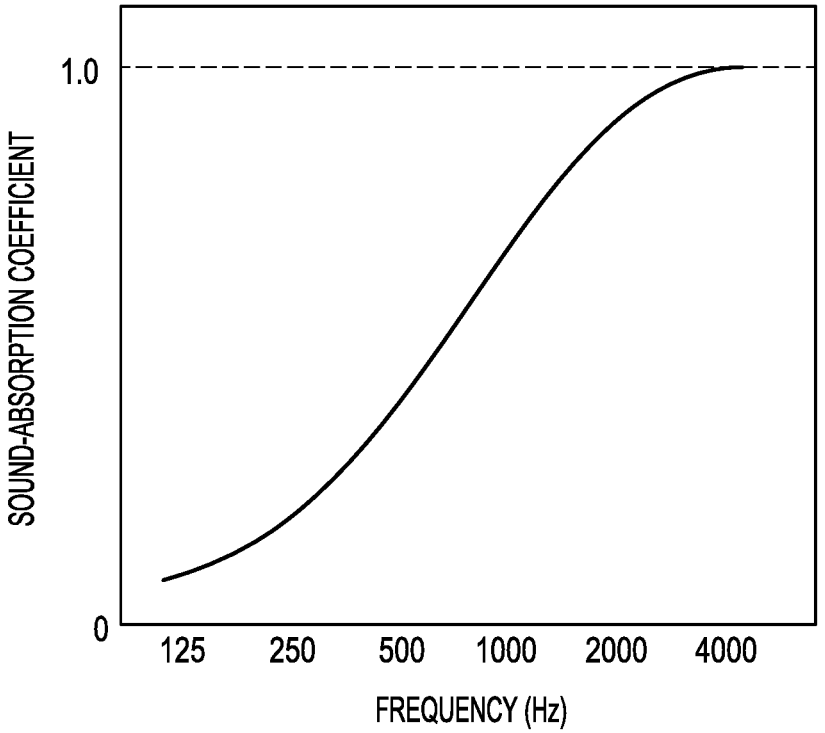
FIG. 7 is a graph that shows the sound-absorption coefficient of a representative sound-absorbing member according to the first embodiment.

FIG. 7 is a graph that shows the sound-absorption coefficient of a representative sound-absorbing member 30 according to the present teachings. In FIG. 7, the abscissa represents the frequency, and the ordinate represents the sound-absorption coefficient. Wind noise is typically on the order of approximately 2,000 Hz. As shown in FIG. 7, if a porous member having open cells is used as the sound-absorbing member 30, noise at a frequency of 2,000 Hz or higher can be effectively reduced by the representative sound-absorbing member 30.

Thus, the sound-absorbing member 30 preferably exhibits a sound-absorbing coefficient at 1,000 Hz of 0.3 or more, 0.4 or more, 0.5 or more or 0.6 or more, at 2,000 Hz of 0.6 or more, 0.7 or more, 0.8 or more or 0.9 or more.

Figure 8:
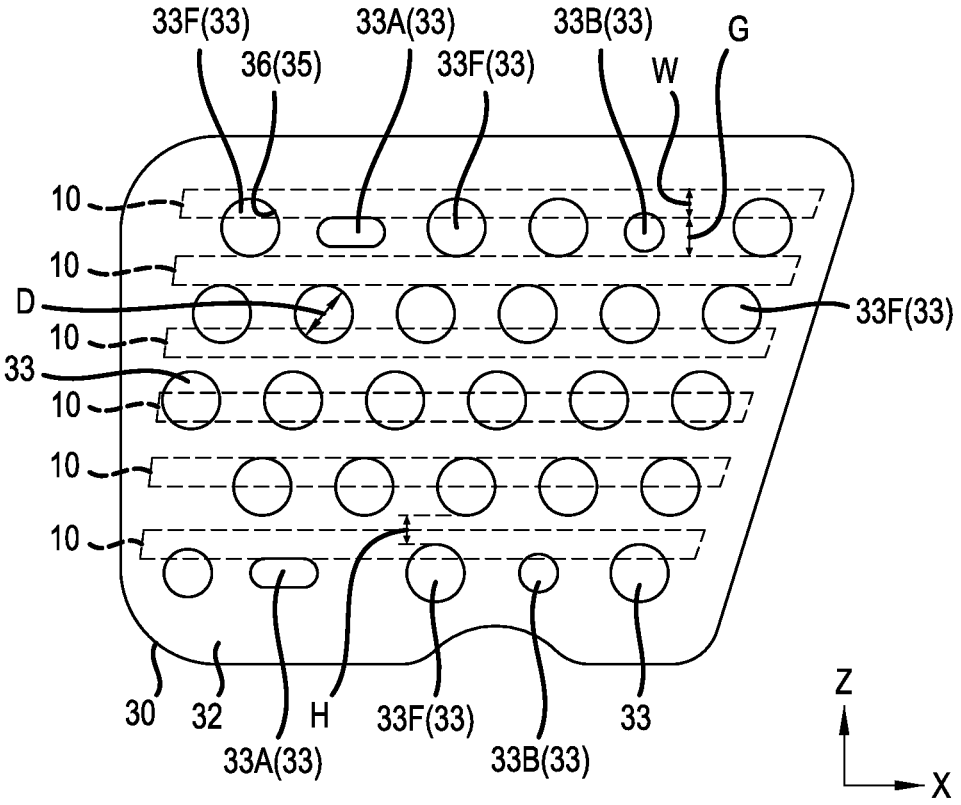
FIG. 8 is a drawing for explaining the relationship between the sound-absorbing member and air-exhaust ports according to the first embodiment.

FIG. 8 is a drawing for explaining a preferred, non-limiting relationship between the sound-absorbing member 30 and the air-exhaust ports 10 according to the embodiment. The air-exhaust ports 10 each have a slit shape that is elongated in the X-axis (first) direction. The longitudinal direction of the air-exhaust ports 10 is the X-axis direction. The latitudinal direction of the air-exhaust ports 10 is the Z-axis (second) direction.

A plurality of the air-exhaust ports 10 is provided in the Z-axis direction spaced apart from one another by a constant spacing in the Z-axis direction. In the first embodiment, six air-exhaust ports 10 are provided in the Z-axis direction.

A plurality of the through holes 33 is provided in both the Z-axis direction and the X-axis direction, preferably spaced apart from one another by a constant spacing in the Z-axis direction and a constant spacing in the X-axis direction.

The through holes 33 include a plurality of through holes 33F that permit the exhaust air to pass therethrough, two through holes 33A, and two through holes 33B.

The through holes 33F differ in function from the through holes 33A and the through holes 33B as will be described below.

The first opening 35 and the second opening 36 of each through hole 33F are substantially true-circle shaped in the first embodiment. The size of the first opening 35 and the size of the second opening 36 of each through hole 33F are substantially equal and preferably the through holes 34 have an at least substantially constant cross-section along their longitudinal lengths, as was described above.

Inner diameter D of the first opening 35 of each through hole 33F is larger than dimension (width) W of each air-exhaust port 10 in the Z-axis direction.

Inner diameter D of the first opening 35 of each through hole 33F is larger than spacing G of the air-exhaust ports 10 in the Z-axis direction.

Spacing H between the first openings 35 of the through holes 33F in the Z-axis direction is substantially equal to spacing G of the air-exhaust ports 10 in the Z-axis direction. It is noted that spacing H may be larger or smaller than spacing G.

The two through holes 33A are disposed in the Z-axis direction in a front part (+X side) of the sound-absorbing member 30 and are respectively provided for receiving support (retaining) members 38, as well be further explained below. The first opening 35 and the second opening 36 of each through hole 33A are each a substantially oval or ellipse shape that is elongated (has a longest dimension or semi-major axis) in the X-axis direction. The size of the first opening 35 of each through hole 33A is equal or at least substantially equal to the size of the second opening 36 of each through hole 33A. In the Z-axis direction, the dimension (semi-minor axis) of each through hole 33A is smaller than the dimension (diameter) of each through hole 33F.

The two through holes 33B are disposed in the Z-axis direction in a rear part (−X side) of the sound-absorbing member 30 and also are respectively provided for receiving support (retaining) members 38, as well be further explained below. The first opening 35 and the second opening 36 of each through hole 33B are each substantially true-circle shaped. The size of the first opening 35 of each through hole 33B is equal or at least substantially equal to the size of the second opening 36 of each through hole 33B. The inner diameter of each through hole 33B is smaller than the inner diameter of each through hole 33F.

Support Member(s)

Figure 9:
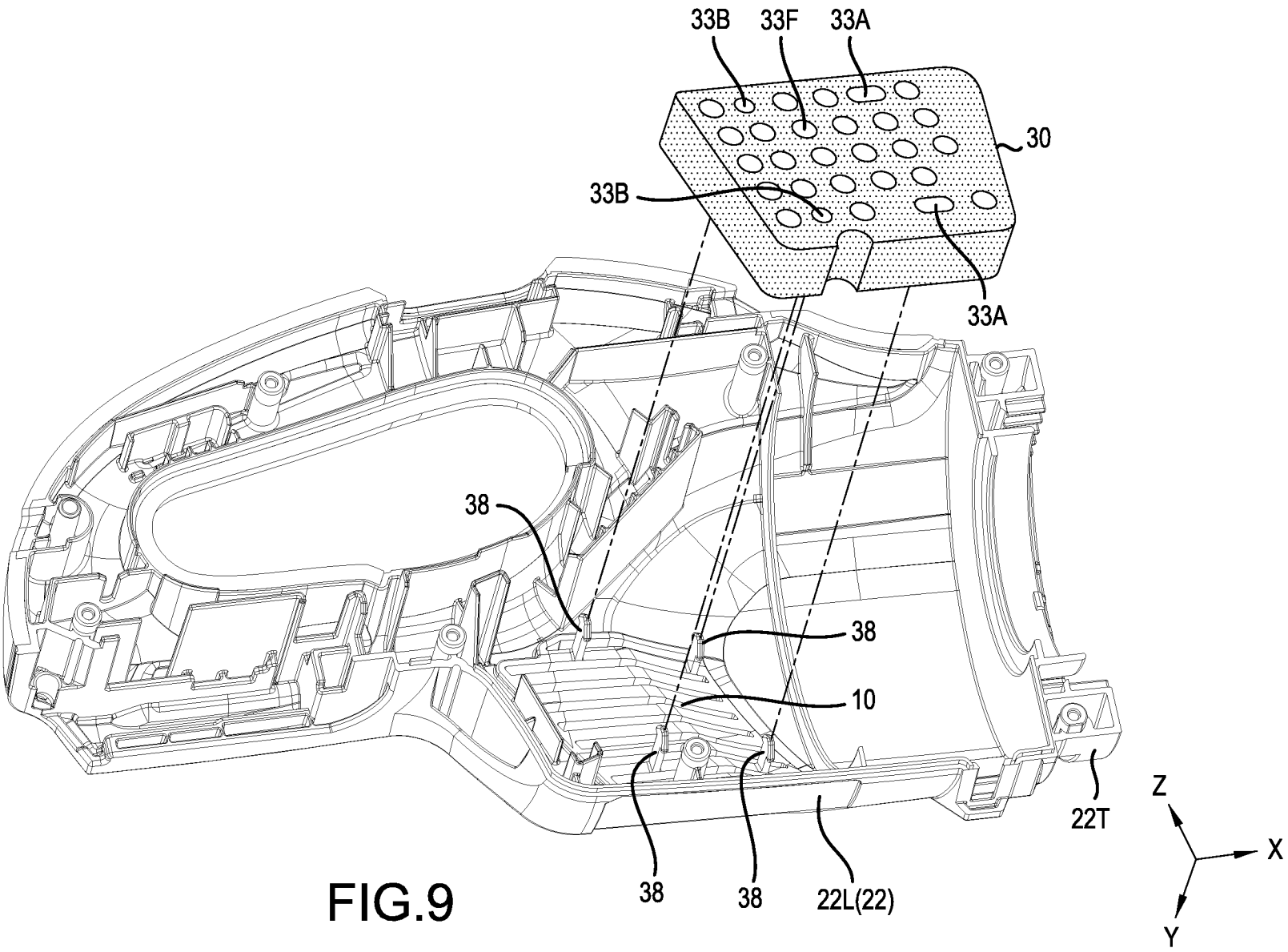
FIG. 9 shows support members according to the first embodiment.

FIG. 9 shows support (retaining) members 38 according to the first embodiment. The support members 38 support the sound-absorbing member 30. As shown in FIG. 9, the handheld vacuum cleaner 1 comprises a plurality of (in this example, four) support members 38, which are disposed in the through holes 33A and 33B when the sound-absorbing member 30 is mounted on the inner surface of the rear housing 22. The support members 38 protrude from the inner surface of the rear housing 22, which faces the Y-axis direction, toward the center of the interior space of the rear housing 22 in the Y-axis direction. The support members 38 are provided on the inner surface of the rear housing 22 at least partially around the air-exhaust ports 10.

Two of the support members 38 are disposed in the X-axis direction in the vicinity of the air-exhaust ports 10, among the plurality of air-exhaust ports 10 disposed in the Z-axis direction, that are disposed most on the +Z side. Two of the support members 38 are disposed in the X-axis direction in the vicinity of the air-exhaust ports 10, among the plurality of air-exhaust ports 10 disposed in the Z-axis direction, that are disposed most on the −Z side.

It is noted that at least one of the support members 38 is provided on the inner surface of the rear housing 22 between two adjacent air-exhaust ports 10.

The support members 38 are respectively inserted into the through holes 33A, B of the sound-absorbing member 30. In the first embodiment, two of the support members 38 disposed on the +X side are respectively inserted into the through holes 33A. Two of the support members 38 disposed on the −X side are respectively inserted into the through holes 33B.

Figure 10:
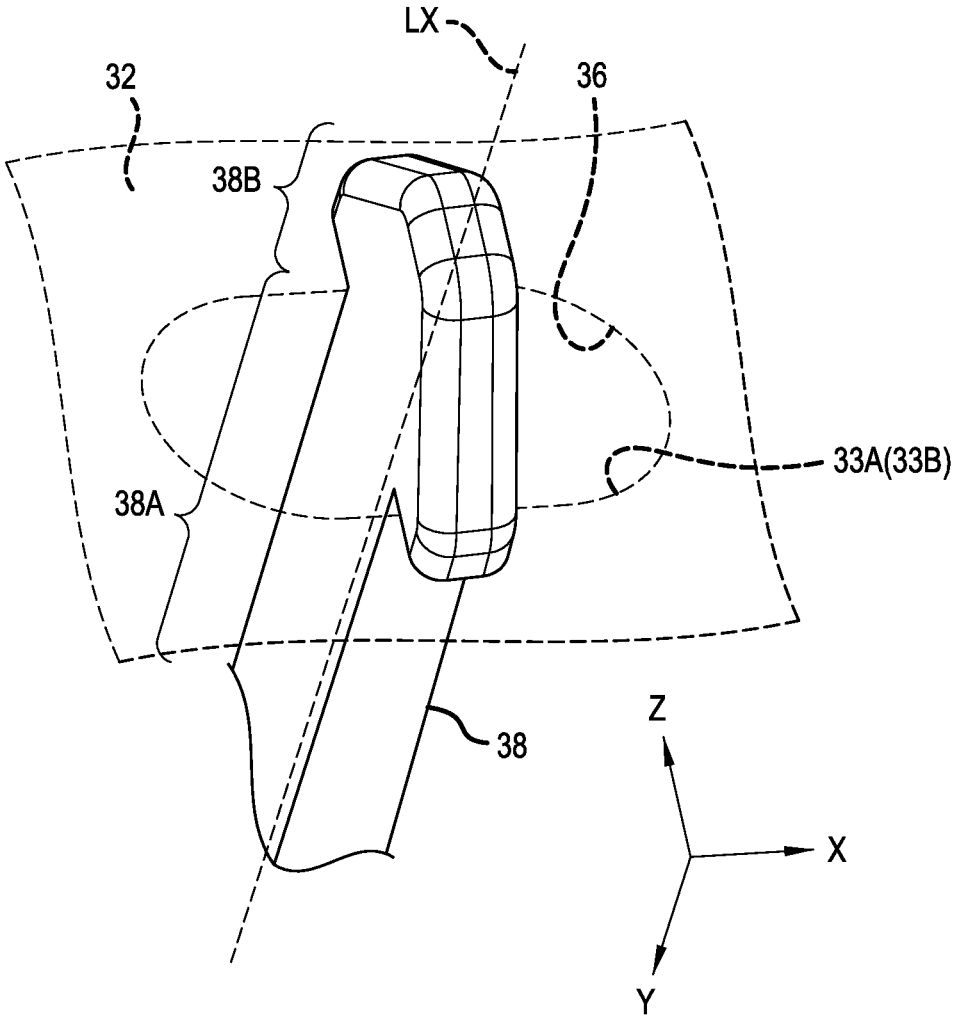
FIG. 10 is an oblique view of one of the support members according to the first embodiment.

FIG. 10 is an oblique view of one of the support members 38 according to the first embodiment. As shown in FIG. 10, the support member 38 comprises a rod portion 38A, which is fixed to the inner surface of the rear housing 22 and a hook portion 38B, which is disposed at the tip (terminal end) of the rod portion 38A. Centerline LX of the rod portion 38A is substantially parallel to the Y axis. Within an XZ plane orthogonal to the Y axis, the outer shape (dimension) of the hook portion 38B is larger than the outer shape (dimension) of the rod portion 38A. In addition, within the XZ plane, the dimension of the hook portion 38B in the Z-axis direction is larger than the dimension of the hook portion 38B in the X-axis direction.

By inserting the support members 38 into the respective through holes 33A, 33B, the sound-absorbing member 30 is fixed to (retained on) the rear housing 22. The support members 38 are inserted into the through holes 33 (33A, 33B) such that the inner surfaces of the through holes 33 (33A, 33B) are disposed around the rod portions 38A. Because the inner surfaces of the through holes 33 (33A, 33B) are disposed around the rod portions 38A, as shown in FIG. 10, the hook portion 38B protrudes from the second surface 32. At least a portion of the second surface 32 is hooked (held) by the hook portion 38B. Thereby, the sound-absorbing member 30 is supported by the support members 38 and fixed to the rear housing 22.

Within the XZ plane, the dimension of the hook portion 38B in the Z-axis direction is larger than the dimension of the hook portion 38B in the X-axis direction. Within the XZ plane, the dimension of the through hole 33A in the Z-axis direction is smaller than the dimension of the through hole 33A in the X-axis direction. The dimension of the hook portion 38B in the Z-axis direction is larger than the dimension of the through hole 33A in the Z-axis direction. Thereby, in the state in which the support member 38 has been inserted into the through hole 33A, the hook portion 38B is hooked to the second surface 32. In addition, within the XZ plane, the dimension of the hook portion 38B in the Z-axis direction is larger than the dimension of the through hole 33B. Thereby, in the state in which the support member 38 has been inserted into the through hole 33B, the hook portion 38B is hooked to the second surface 32. If the sound-absorbing member 30 is a soft porous member, such as a sponge or foam, then the support members 38 can be smoothly inserted into both the through holes 33A and the through holes 33B.

Drive Unit

Figure 11:
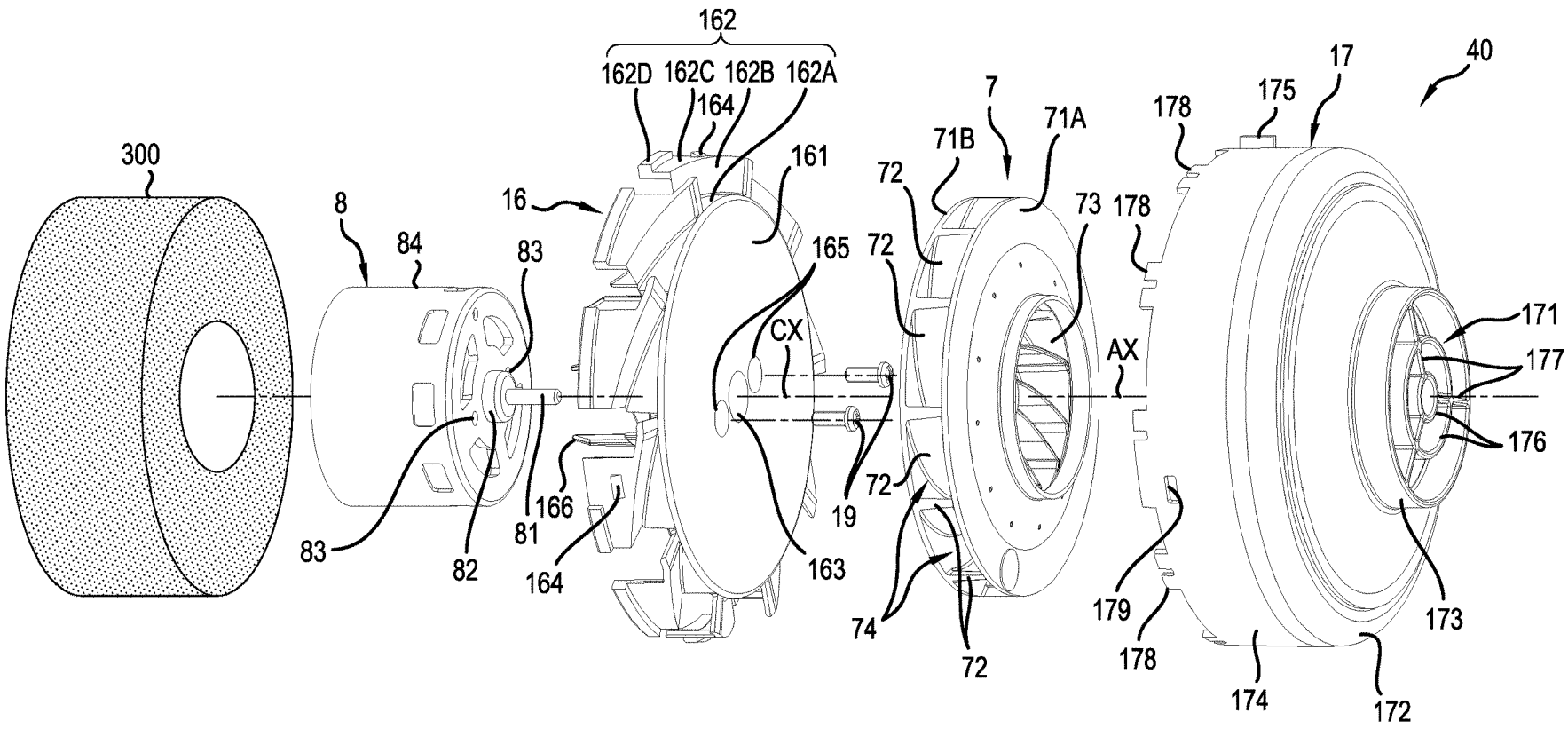
FIG. 11 is an exploded, oblique view of a drive unit according to the first embodiment.
Figure 12:
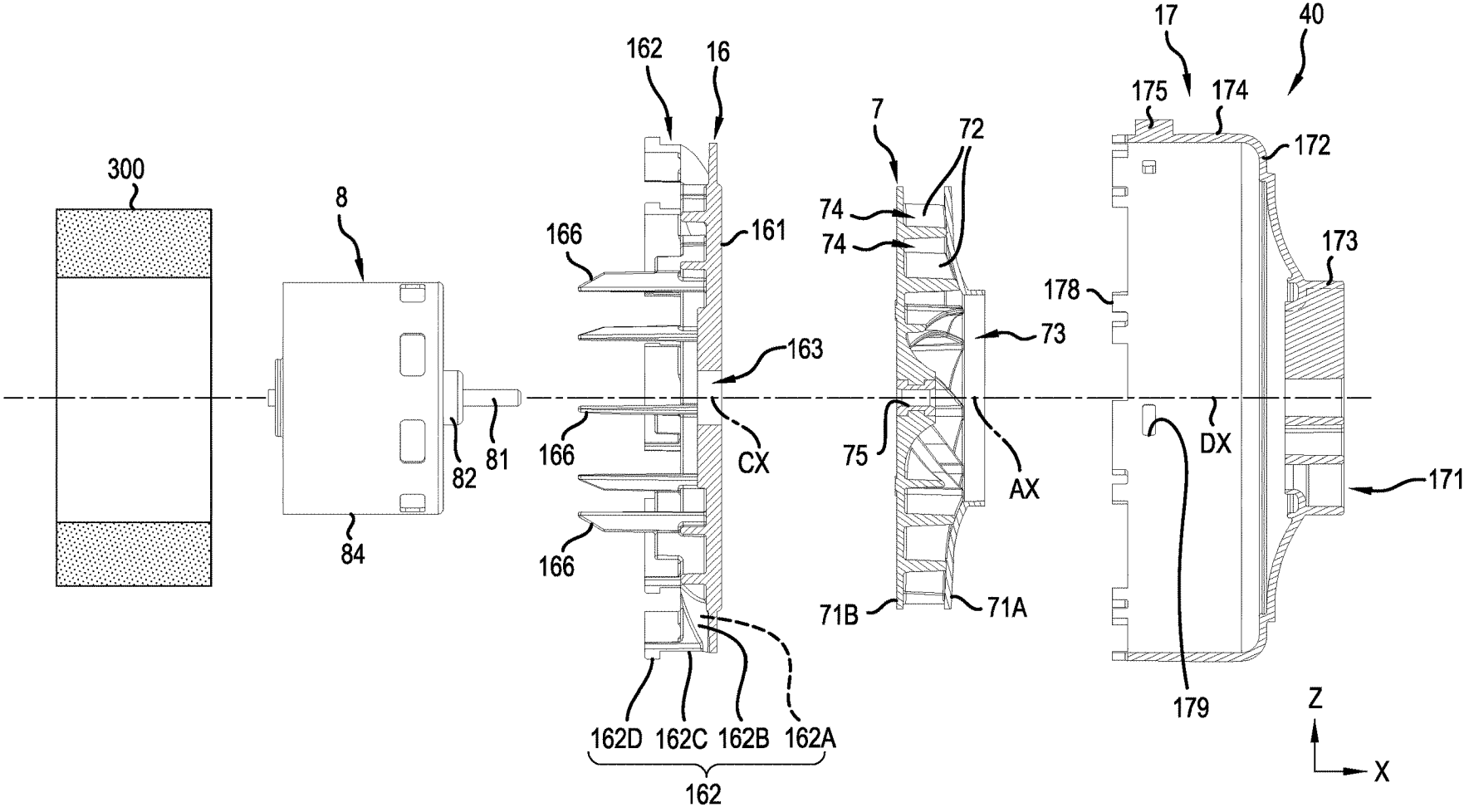
FIG. 12 is an exploded, cross-sectional view of the drive unit according to the first embodiment.
Figure 13:
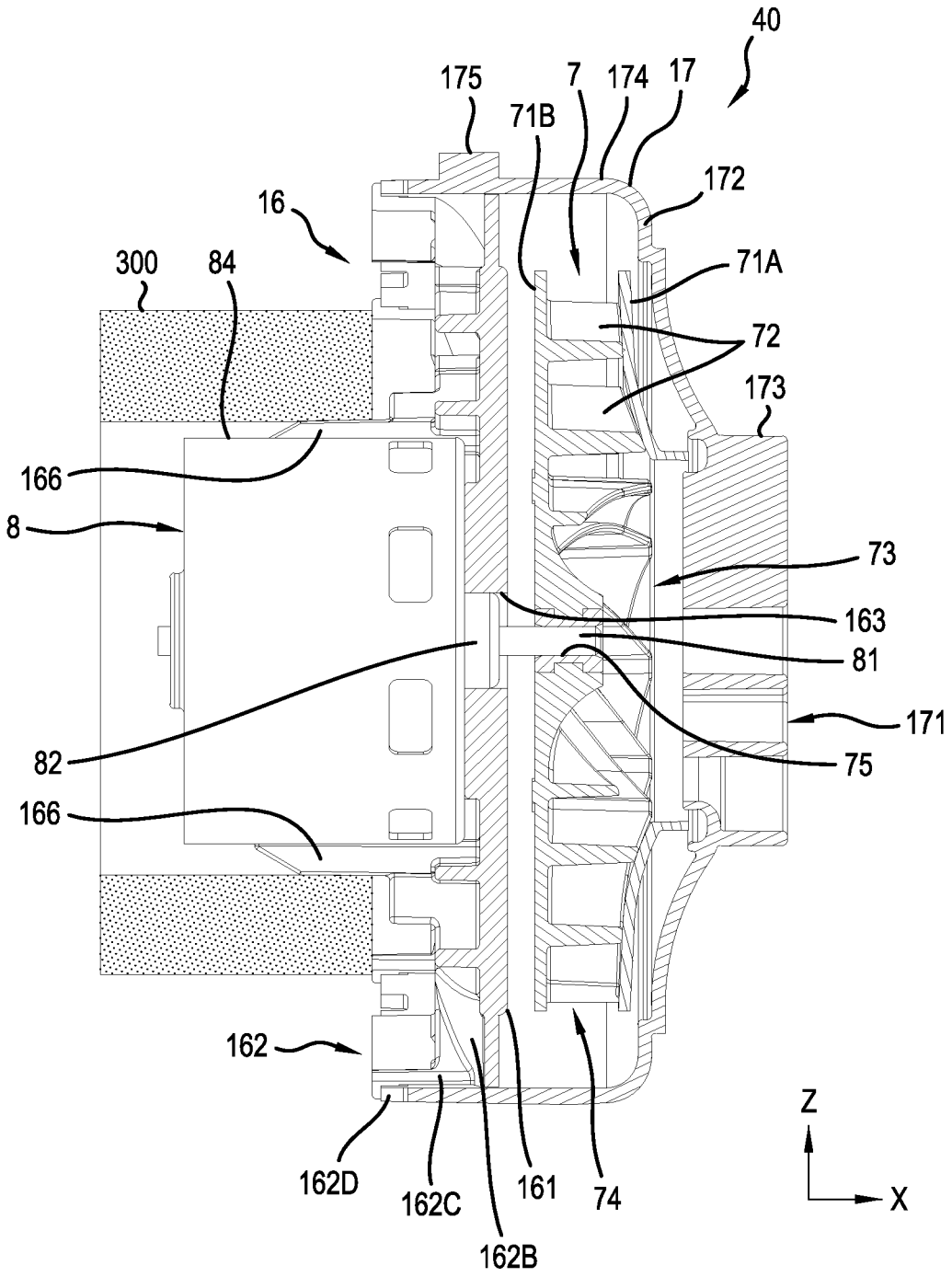
FIG. 13 is a cross-sectional view of the drive unit according to the first embodiment.
Figure 14:
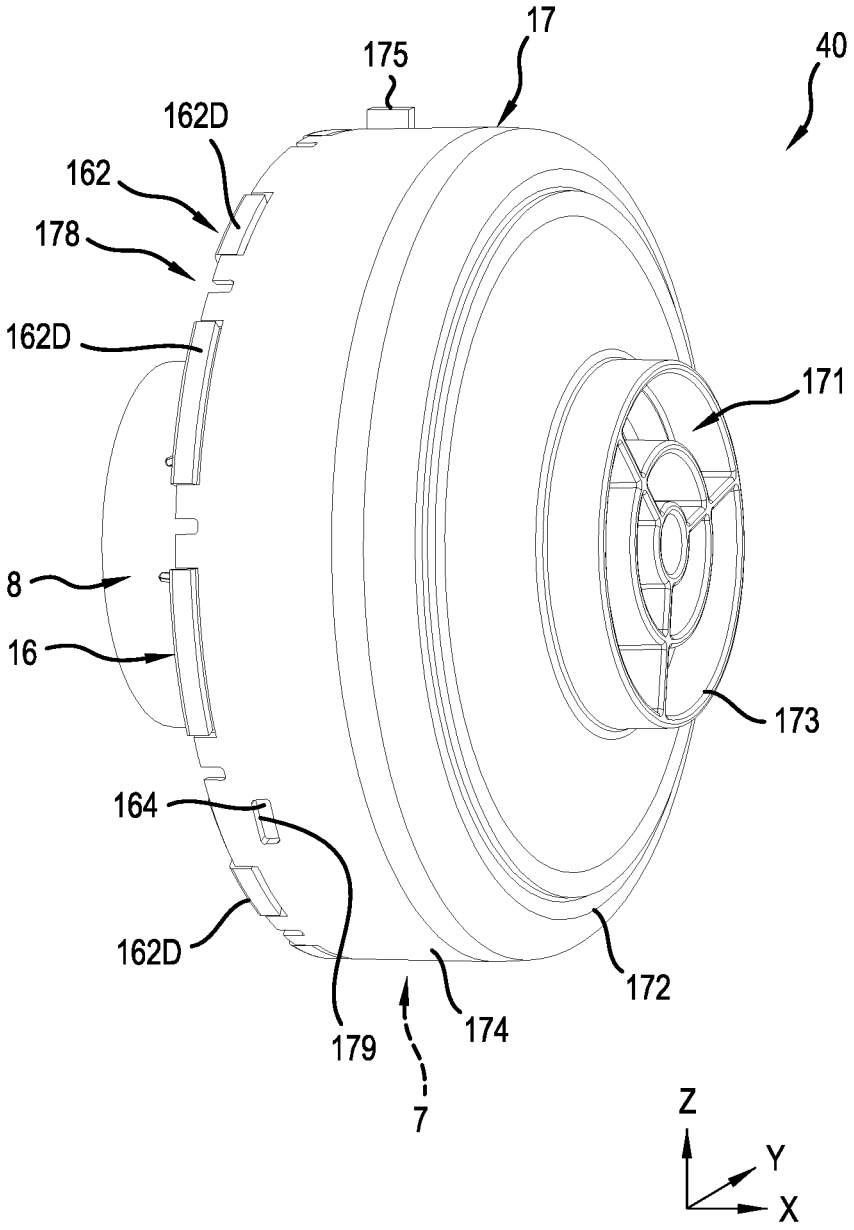
FIG. 14 is an oblique view of the drive unit according to the first embodiment.

FIG. 11 is an exploded, oblique view of the drive unit 40 according to the first embodiment. FIG. 12 is an exploded, cross-sectional view of the drive unit 40 according to the first embodiment. FIG. 13 is a cross-sectional view of the drive unit 40 according to the first embodiment. FIG. 14 is an oblique view of the drive unit 40 according to the first embodiment.

The drive unit 40 comprises the fan 7, the motor 8, the motor base 16, and the fan cover 17.

The fan 7 rotates about rotary shaft AX. The fan 7 is a centrifugal fan. The fan 7 comprises: a front plate 71A, which has a suction port 73; a rear plate 71B, which is disposed rearward of the front plate 71A; and blades 72, which are disposed between the front plate 71A and the rear plate 71B. A plurality of the blades 72 is disposed around rotary shaft AX. A blow-out port 74 is provided between each pair of adjacent blades 72.

The motor 8 is driven by the electric current (power) supplied by the battery 5. The motor 8 is disposed rearward of the fan 7. The motor 8 comprises an output shaft 81 and a bearing 82, which rotatably supports the output shaft 81. Another (not shown) bearing may rotatably support the output shaft 81 on the side of the motor 8 that is opposite of the fan 7.

The fan 7 has an insertion hole 75, into which the output shaft 81 of the motor 8 is inserted. When the output shaft 81 is inserted into the insertion hole 75, the motor 8 and the fan 7 are coupled. When the output shaft 81 rotates the fan 7, air is sucked in via the suction port 73 and is subsequently blown out via the blow-out ports 74 in the radial direction of rotary shaft AX.

The motor base 16 fixes the motor 8 to the rear housing 22. Central axis CX of the motor base 16 coincides with rotary shaft AX of the fan 7. The motor base 16 comprises a baseplate 161 and baffles 162.

The baseplate 161 has a discoidal shape. The baseplate 161 opposes the rear plate 71B of the fan 7. An insertion hole 163 is provided in a center part of the baseplate 161. The output shaft 81 and the bearing 82 of the motor 8 are inserted into the insertion hole 163.

The baffles 162 rearwardly guide the air that was blown out via the blow-out ports 74 of the fan 7. A plurality of (in the first embodiment, ten) baffles 162 is disposed around central axis CX. on the rear surface of the baseplate 161. Each baffle 162 comprises an inner side wall 162A, a tilted part 162B, an outer side wall 162C, and a stop 162D.

The inner side walls 162A of the baffles 162 are fixed to the rear surface of the baseplate 161 and protrude rearward therefrom. The tilted parts 162B respectively extend from a rear end of an outer surface of the inner side walls 162A outwardly in the radial direction of central axis CX. The outer side walls 162C respectively protrude rearward from a circumferential-edge part of the tilted parts 162B. The stops 162D respectively protrude from a rear end of an outer surface of the outer side walls 162C outwardly in the radial direction of central axis CX.

Projections 164 respectively protrude from the outer surface of the outer side walls 162C outwardly in the radial direction of central axis CX.

The motor base 16 comprises a plurality of fixing ribs 166 around central axis CX, which fix (hold) the motor 8. The fixing ribs 166 are provided on the rear surface of the baseplate 161 and protrude rearward therefrom. When the output shaft 81 and the bearing 82 of the motor 8 are inserted into the insertion hole 163, the fixing ribs 166 are disposed around a body 84 of the motor 8, which comprises a stator. Thus, the body 84 is sandwiched (encircled) by the plurality of fixing ribs 166. The motor 8 and the motor base 16 are positioned by virtue of the plurality of fixing ribs 166 being disposed around the body 84. When the fixing ribs 166 have been brought into contact with the body 84, the fixing ribs 166 protrude outwardly in the radial direction of central axis CX. The body 84 dissipates heat via the fixing ribs 166, and thereby the temperature of the motor 8 is prevented from rising excessively.

Furthermore, when the fixing ribs 166 are disposed around the body 84, the motor 8 and the motor base 16 are fixed by one or more screws 19. Holes 165, in which the screws 19 are disposed, are provided in the motor base 16. Screw holes 83, in which the screw threads of the screws 19 engage, are provided in the motor 8.

The fan cover 17 houses the fan 7 and the motor base 16. The fan cover 17 fixes the motor base 16 to the rear housing 22. The fan cover 17 comprises: a front-plate portion 172, which has a suction port 171; a circular-tube portion 173, which protrudes forward from the front-plate portion 172 and is disposed such that it surrounds the suction port 171; an outer-tube portion 174, which is connected to a circumferential-edge portion of the front-plate portion 172; and a projection 175, which is provided on the outer-tube portion 174.

The front-plate portion 172 has a discoidal (disk-like) shape. The suction port 171 is provided in the center of the front-plate portion 172. The circular-tube portion 173 protrudes forward from the front-plate portion 172. The suction port 171 is provided in the interior of the circular-tube portion 173. Circular-tube portions 176 and ribs 177 are disposed in the interior of the circular-tube portion 173. The ribs 177 are fixed to both the circular-tube portion 173 and the circular-tube portions 176. The outer-tube portion 174 protrudes rearward from the circumferential-edge portion of the front-plate portion 172. Projections 178, which protrude rearward, are provided on a rear-end portion of the outer-tube portion 174. Holes 179, in which the projection portions 164 are disposed, are provided in portions of the outer-tube portion 174.

The fan 7 and the motor base 16 are disposed in the interior of the fan cover 17. The outer-tube portion 174 of the fan cover 17 is disposed around the fan 7 and the motor base 16. The projection portions 164 of the motor base 16 are disposed in the holes 179, which are provided in the outer-tube portion 174. The motor base 16 and the fan cover 17 are positioned by virtue of the projection portions 164 being disposed in the holes 179.

The rear-end portion of the outer-tube portion 174 makes contact with the stops 162D of the motor base 16. The motor base 16 and the fan cover 17 are positioned by virtue of the rear-end portion of the outer-tube portion 174 and the stops 162D making contact. The projection portions 178 of the outer-tube portion 174 are disposed between respective pairs of adjacent stops 162D.

The inner surface of the outer-tube portion 174 opposes the baffles 162 of the motor base 16. The inner surface of the outer-tube portion 174 opposes the outer surfaces of the outer-side-wall portions 162C.

The suction port 171 of the fan cover 17 faces the filter 15. The air that passes through the filter 15 is sucked in via the suction port 171. The air that passes through the suction port 171 is sucked in via the suction port 73 of the fan 7. The air that passes through the suction port 73 is blown out via the blow-out ports 74 in the radial direction of rotary shaft AX.

The air blown out via the blow-out ports 74 is guided to the rear of the motor base 16 by the baffles 162. At least some of the air blown out via the blow-out ports 74 flows through a passageway defined by the inner side walls 162A, the tilted parts 162B, and the inner surface of the outer-tube portion 174 of the fan cover 17. The air that passes through the motor base 16 passes through the sound-absorbing member 30, and then is exhausted to the exterior of the housing 2 via the air-exhaust ports 10.

A sound-absorbing member 300 is disposed around the body 84 of the motor 8. The sound-absorbing member 300 absorbs noise generated by the motor 8. The sound-absorbing member 300 also may be made of a porous member having open cells. Any of the porous materials described above for the sound-absorbing member 30 may be used to form the sound-absorbing member 300, although the sound-absorbing member 300 preferably does not include through-holes 33. Furthermore, it is preferable that the porous material is selected to specifically attenuate noise generated by the motor 8, which has a different frequency than the wind noise and fan noise generated by the air circulating through the housing 2. Therefore, in some embodiments, the sound-absorbing member 30 may be composed of a different porous material (or the same porous material having different cell sizes, thickness, etc.) than the sound-absorbing member 300.

The sound-absorbing member 300 preferably has a circular-cylindrical shape or any other shape that is complementary to the outer shape of the body 84. At least a portion of the body 84, or preferably all of the body 84, is inserted into the interior of the sound-absorbing member 300. The sound-absorbing member 300 is disposed around the body 84 such that it contacts the fixing ribs 166. When the fixing ribs 166 are in contact with the body 84, the fixing ribs 166 protrude outwardly in the radial direction of central axis CX. The sound-absorbing member 300 is disposed such that it covers the body 84 and the fixing ribs 166. The sound-absorbing member 300 is fixed to the fixing ribs 166.

Figure 15:
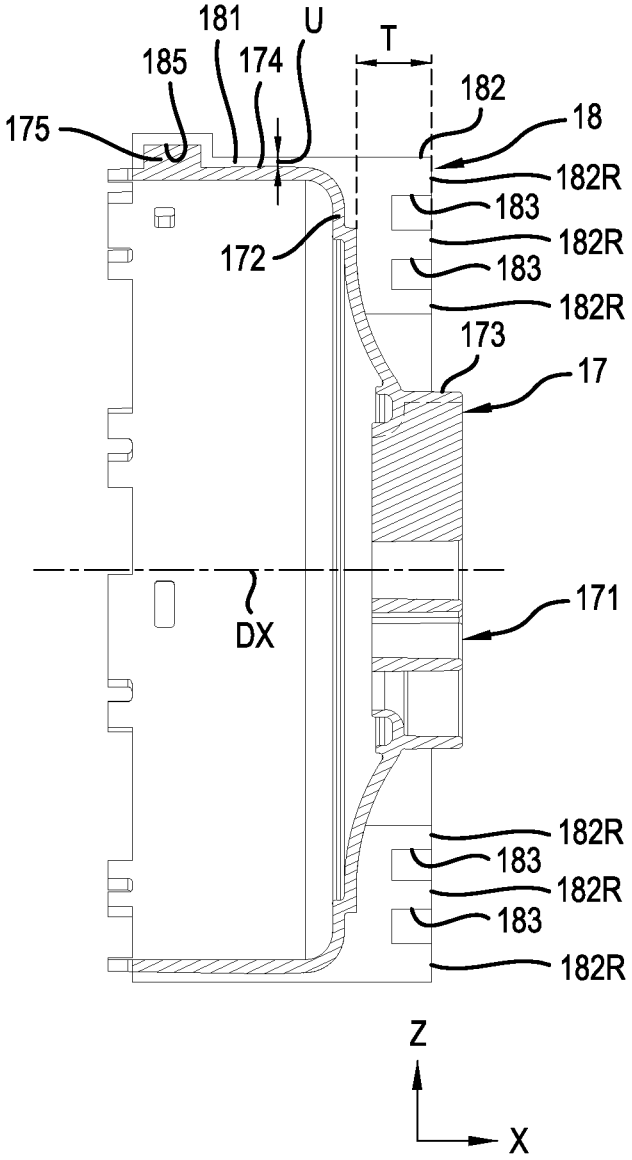
FIG. 15 is a cross-sectional view of a rubber vibration isolator according to the first embodiment.
Figure 16:
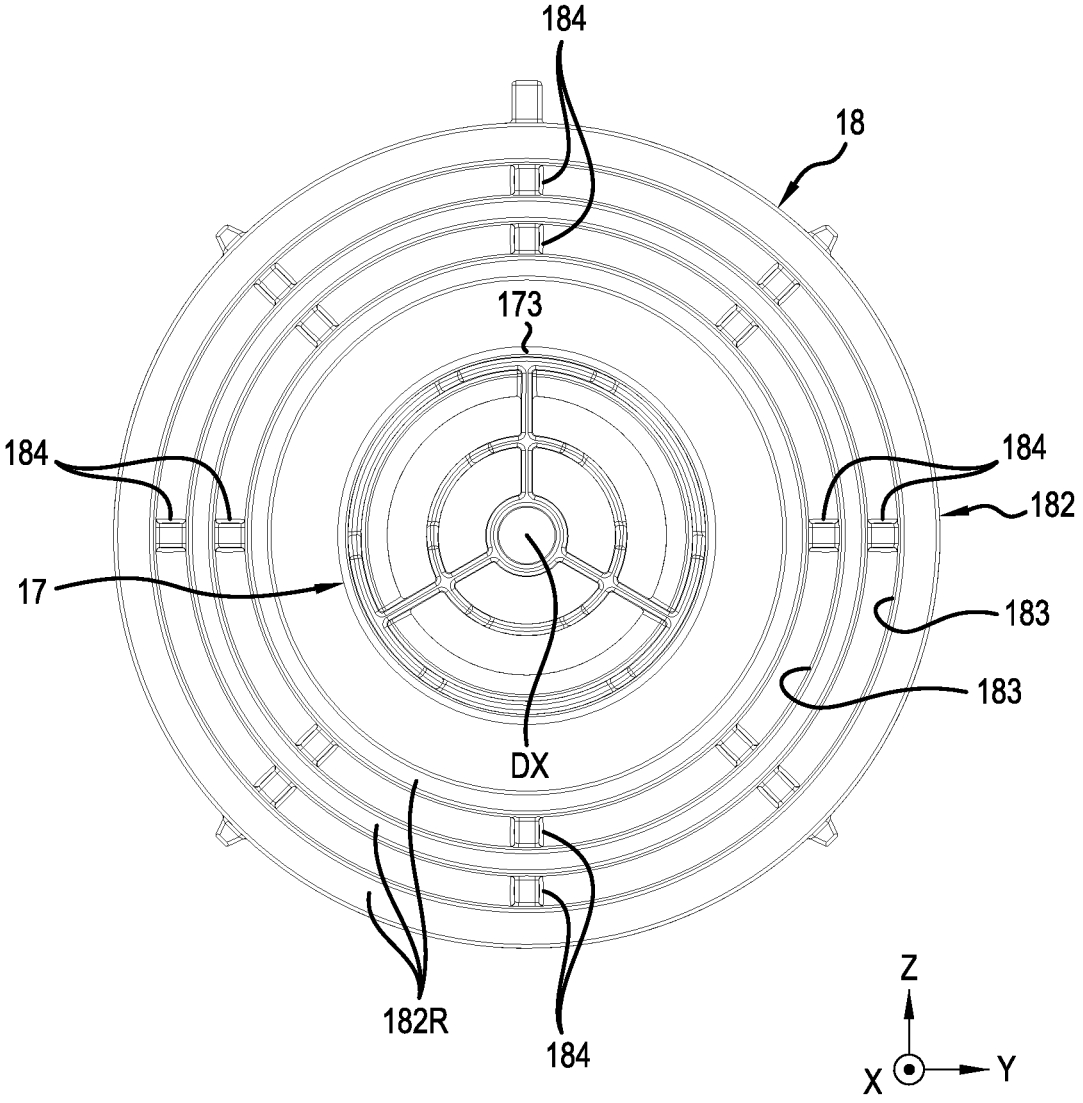
FIG. 16 is a front view of the rubber vibration isolator according to the first embodiment.

FIG. 15 is a cross-sectional view that shows the rubber vibration isolator 18 according to the first embodiment. FIG. 16 is a front view that shows the rubber vibration isolator 18 according to the first embodiment. In FIG. 15, the fan cover 17 and the rubber vibration isolator 18 are shown, but the fan 7, the motor 8, and the motor base 16 are omitted.

As shown in FIG. 15 and FIG. 16, the rubber vibration isolator 18 comprises a covering portion 181, which covers the outer-tube portion 174, and a protruding portion 182, which is disposed such that it covers at least a portion of the front-plate portion 172. The protruding portion 182 protrudes forward from the front-plate portion 172 and is disposed such that it surrounds the circular-tube portion 173. The protruding portion 182 has a circular-cylindrical shape that surrounds central axis DX of the fan cover 17. In a direction parallel to central axis DX, dimension T of the protruding portion 182 is larger than thickness U of the covering portion 181. As shown in FIG. 2, a front-end surface of the protruding portion 182 makes contact with at least a portion of the rear housing 22.

The rubber vibration isolator 18 has grooves 183, which are provided in the front-end surface of the protruding portion 182. As shown in FIG. 16, the grooves 183 have a circular-ring (e.g., annular) shape in a plane orthogonal to central axis DX. Dual grooves 183 are provided in the radial direction of central axis DX.

Owing to the grooves 183, a plurality of ribs 182R is provided on the protruding portion 182 in the radial direction of central axis DX. As shown in FIG. 16, coupling ribs 184 are provided on inner sides of the grooves 183 such that the ribs 182R, which are disposed in the radial direction of central axis DX, are coupled (attached, linked).

The projection 175, which is provided on the outer-tube portion 174 of the fan cover 17, protrudes from an outer surface of the outer-tube portion 174 outwardly in the radial direction of central axis DX of the fan cover 17. The covering portion 181 has a recess 185, in which the projection 175 is disposed (inserted, engaged). The fan cover 17 and the rubber vibration isolator 18 are positioned by virtue of the projection portion 175 being disposed in the recess 185.

It is noted that the rubber vibration isolator 18 may be manufactured by insert molding.

The rubber vibration isolator 18 has a Shore hardness of, for example, Hs 30 or less. The rubber vibration isolator 18 bends easily owing to dimension T of the protruding portion 182 being sufficiently large and the ribs 182R being provided. Thereby, the rubber vibration isolator 18 can exhibit a sufficient vibration-isolating effect.

Seal Structure

Figure 17:
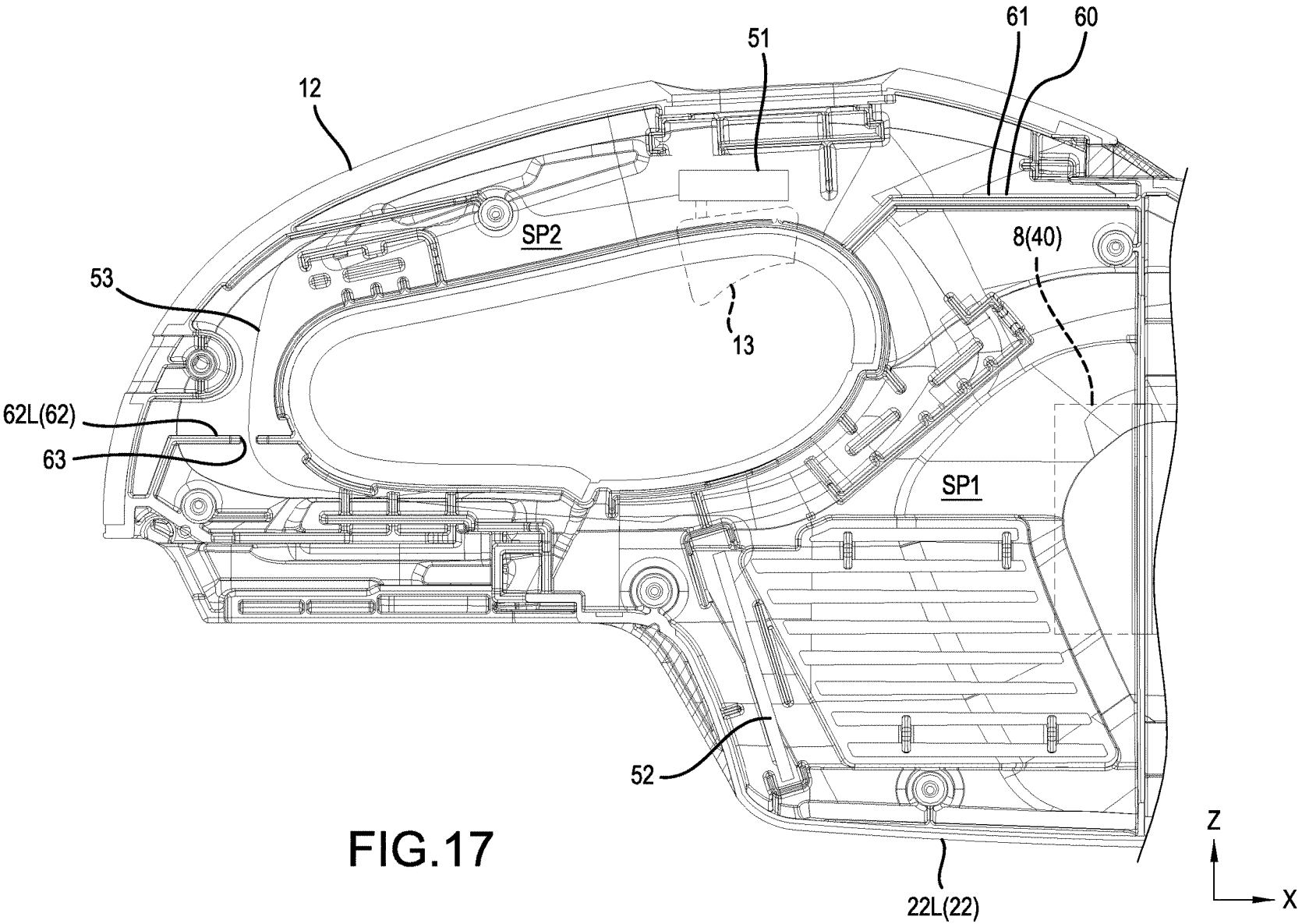
FIG. 17 shows an interior space of a housing according to the first embodiment.

FIG. 17 is a drawing that shows the interior space of the housing 2 according to the first embodiment. FIG. 17 shows the state in which the right housing 22R has been removed from the rear housing 22. As shown in FIG. 17, the handheld vacuum cleaner 1 comprises: a switching device 51, which is operated (manipulated) by the pulling (depressing) the trigger switch 13; a control circuit board 52, which controls the handheld vacuum cleaner 1; and an electrical cable 53, which electrically connects the switching device 51 to the control circuit board 52. When the trigger switch 13 is pulled by the user, the switching device 51 outputs an operation signal. The operation signal is input into the control circuit board 52 via the electrical cable 53. The control circuit board 52 drives the motor 8 based on the operation signal.

The interior space of the housing 2 includes: a first space SP1, in which the drive unit 40 comprising the fan 7 and the motor 8 is disposed; and a second space SP2, which is partitioned from the first space SP1 by a partition wall 60.

The second space SP2 includes the interior space of the handle 12. The partition wall 60 comprises: a first partition wall 61, which partitions a front portion of the second space SP2 from the first space SP1; and a second partition wall 62, which partitions a rear portion of the second space SP2 from the first space SP1.

The trigger switch 13 is provided on the handle 12. The switching device 51 is provided in the second space SP2. The control circuit board 52 and the drive unit 40 are provided in the first space SP1.

The first partition wall 61 is provided on the left housing 22L. It is noted that the first partition wall 61 may be provided on the right housing 22R or may be provided on both the left housing 22L and the right housing 22R.

The second partition wall 62 comprises: a left partition wall 62L, which is provided on the left housing 22L; and a right partition wall 62R, which is provided on the right housing 22R.

The left partition wall 62L includes a recess 63, in which the electrical cable 53 is disposed. One end of the electrical cable 53 is electrically connected to the switching device 51. The other end of the cable 53 is electrically connected to the control circuit board 52. At least a portion (intermediate portion) of the electrical cable 53 is disposed in the recess 63.

Figure 18:
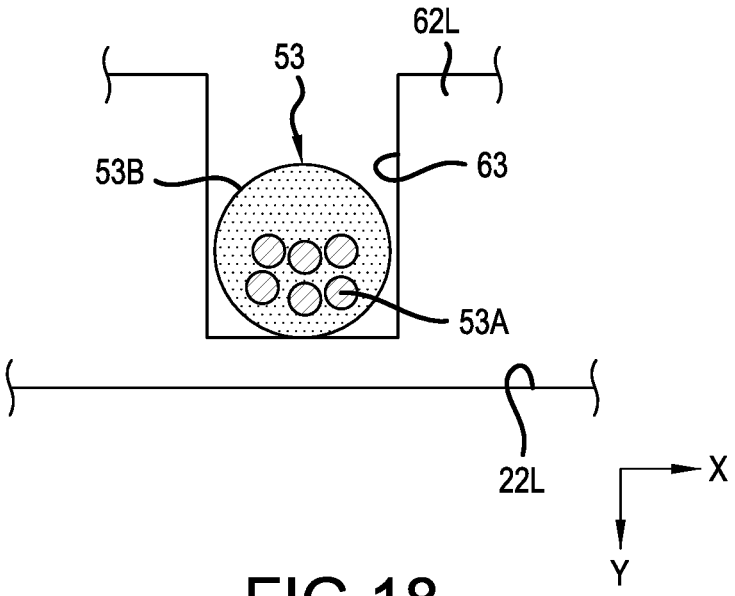
FIG. 18 is a schematic drawing that shows an electrical cable disposed in a recess according to the first embodiment.

FIG. 18 is a schematic drawing that shows the electrical cable 53 disposed in the recess 63 according to the first embodiment. As shown in FIG. 18, the left partition wall 62L of the second partition wall 62 includes the recess 63, in which the electrical cable 53 is disposed.

The electrical cable 53 comprises lead wires 53A and a tube 53B, which is formed of an elastic member and covers (surrounds, protects) the lead wires 53A. Each of the lead wires 53A comprises an electrically conductive member (material) and a covering body, which covers (surrounds, protects) the electrically conductive member. The electrically conductive member of each lead wire 53A is made of a metal such as copper. The tube 53B is made of an elastomer such as rubber or another type of bendable plastic.

Figure 19:
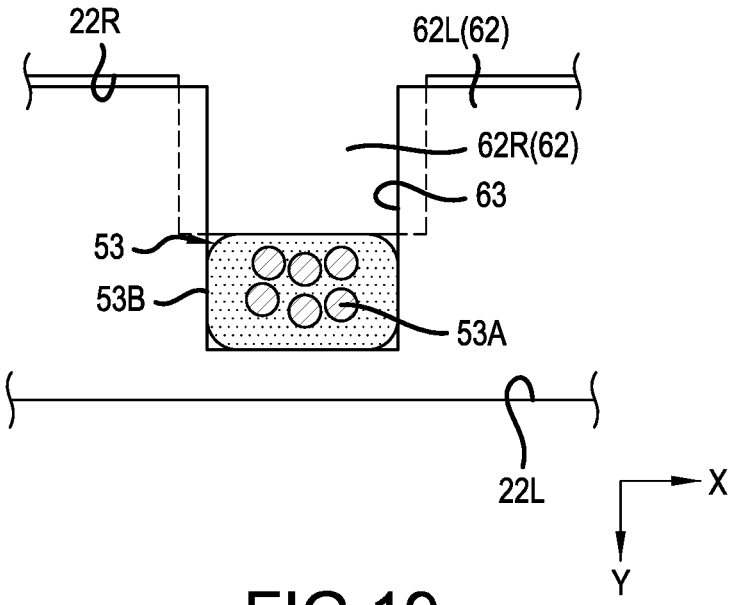
FIG. 19 is a side view that schematically shows a seal structure according to the first embodiment.
Figure 20:
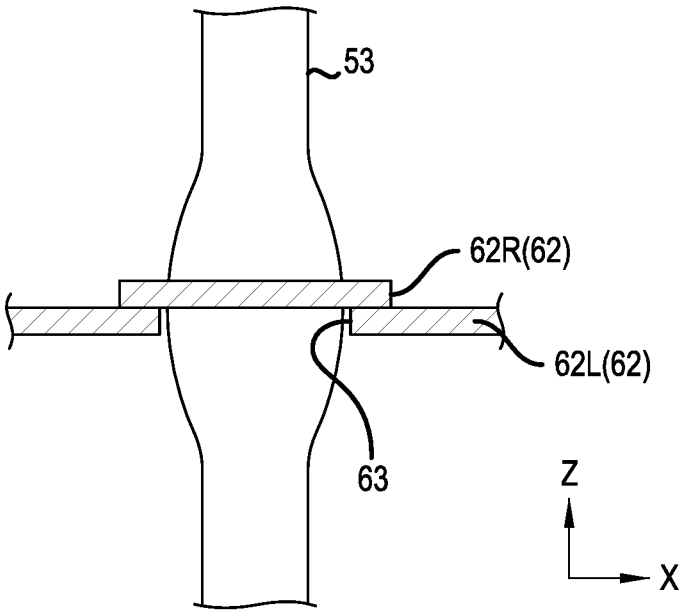
FIG. 20 is a cross-sectional view that schematically shows the seal structure according to the first embodiment.

FIG. 19 is a side view that schematically shows the seal structure according to the first embodiment. FIG. 20 is a cross-sectional view that schematically shows the seal structure according to the first embodiment.

The right partition wall 62R provided on the right housing 22R comprises a protruding portion that pushes the electrical cable 53 disposed in the recess 63. The left partition wall 62L protrudes in the −Y direction from the inner surface of the left housing 22L. The right partition wall 62R protrudes in the +Y direction from the inner surface of the right housing 22R.

The left housing 22L and the right housing 22R are fixed by one or more fasteners such as one or more screws. Prior to fixing the left housing 22L and the right housing 22R by using the fastener(s), the electrical cable 53 is disposed in the recess 63. Then, after the electrical cable 53 has been disposed in the recess 63, the left housing 22L and the right housing 22R are fixed. By virtue of the left housing 22L and the right housing 22R being fixed to one another with the electrical cable 53 disposed in the recess 63, the right partition wall 62R presses and flattens the electrical cable 53 disposed in the recess 63, as can be seen in FIG. 19.

As was noted above, the tube 53B of the electrical cable 53 is preferably elastically deformable. In this case, when the cable 53 is disposed in the recess 63 and the tube 53B is pressed and flattened by the right partition wall 62R, the tube 53B deforms such that it comes into tight contact with the inner surfaces of the recess 63. Thereby, the tube 53B seals the boundary between the first space SP1 and the second space SP2 in the recess 63.

As shown in FIG. 20, the left partition wall 62L has a plate shape and the right partition wall 62R also has a plate shape. Within the XZ plane, the position of the left partition wall 62L and the position of the right partition wall 62R differ (are offset) from one another. When the left housing 22L is fixed to the right housing 22R, a portion of the surface of the left partition wall 62L opposes and a portion of the surface of the right partition wall 62R. Thus, when the left housing 22L has been fixed to the right housing 22R, this portion of the surface of the left partition wall 62L contacts the opposing portion of the surface of the right partition wall 62R.

It is noted that, in the first embodiment, the recess 63 is provided in the left partition wall 62L, and the right partition wall 62R is configured as a protruding portion that presses the cable 53 disposed in the recess 63. Of course, in an alternate embodiment, the recess 63 may be provided in the right partition wall 62R, and the left partition wall 62L may be designed as a protruding portion that presses the cable 53 disposed in the recess 63.

Rotation-Preventing Mechanism

Figure 21:
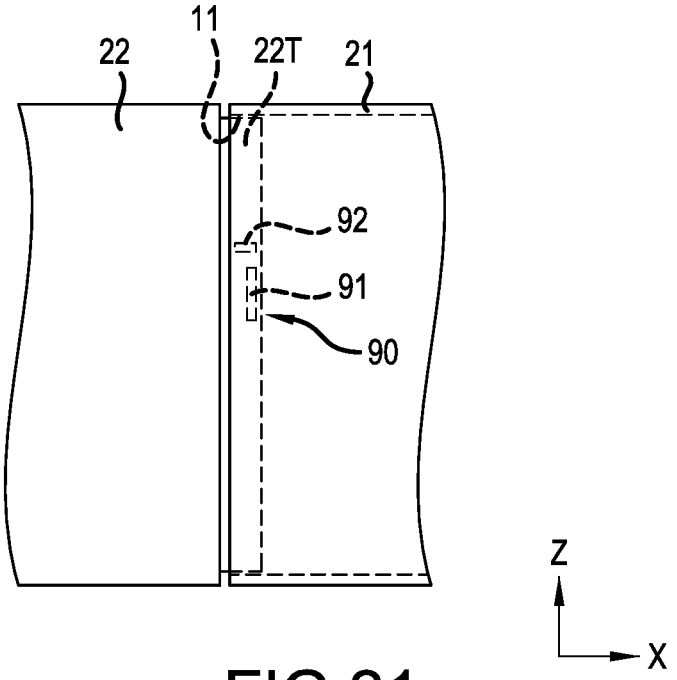
FIG. 21 shows a rotation-preventing mechanism according to the first embodiment.

FIG. 21 shows a rotation-preventing mechanism 90 according to the first embodiment. When at least a portion of the rear housing 22 has been inserted into the opening 11 of the front housing 21, the rotation-preventing mechanism 90 restricts (blocks) relative rotation between the front housing 21 and the rear housing 22. The rotation-preventing mechanism 90 comprises: a first protruding portion 91, which is provided on the front housing 21; and a second protruding portion 92, which is provided on the rear housing 22 and is configured to make contact with the first protruding portion 91.

A tube portion 22T is provided on the front portion of the rear housing 22. The opening 11 is provided in the rear portion of the front housing 21. The outer diameter of the tube portion 22T is smaller than the inner diameter of the opening 11. When the tube portion 22T has been inserted into the opening 11, the front housing 21 and the rear housing 22 are connected to one another.

The first protruding portion 91 protrudes inwardly from the inner surface of the rear portion of the front housing 21. The second protruding portion 92 protrudes outwardly from the outer surface of the tube portion 22T of the rear housing 22. When the tube portion 22T is inserted into the opening 11, the second protruding portion 92 enters the interior space of the front housing 21 such that the position of the first protruding portion 91 in the X-axis direction coincides with the position of at least a portion of the second protruding portion 92 in the X-axis direction. Thereby, even if the front housing 21 and the rear housing 22 attempt to move relative to one another in a rotational direction about the X axis, relative rotation between the front housing 21 and the rear housing 22 is restricted (blocked) by the contact between the first protruding portion 91 and the second protruding portion 92.

It is noted that a tube portion, which is inserted into the rear housing 22, may be provided on the rear-end portion of the front housing 21. The first protruding portion 91 may be provided on the rear housing 22, and the second protruding portion 92 may be provided on the front housing 21.

Operation

Next, the operation of the handheld vacuum cleaner 1 according to the first embodiment will be explained. When the trigger switch 13 is pulled by the user, the motor 8 starts up. The motor 8 is driven by electric power supplied from the battery 5, thereby causing the fan 7 to rotate and generate a suction force at the suction port 3. When the suction force is being generated at the suction port 3, air, dust, debris, etc. in the vicinity of the suction port 3 is suctioned and flows into the interior space of the front housing 21.

Dust, debris, etc. contained in the air that flows into the interior space of the front housing 21 is collected by the filter 15. The air that passes through the filter 15 is sucked in via the suction port 73 of the fan 7 and then is blown out via the blow-out ports 74. The air blown out via the blow-out ports 74 circulates rearward while being guided by the baffles 162 of the motor base 16. The air that passes through the motor base 16 is delivered to the sound-absorbing member 30. At least some of the air delivered to the sound-absorbing member 30 passes (flows) through the through holes 33 (in particular, through holes 33F) and then is exhausted to the exterior space of the housing 2 via the air-exhaust ports 10.

Noise, such as wind noise, is generated by the air that circulates through the interior space of the housing 2 or the air that passes (flows) through the air-exhaust ports 10. In addition, fan noise will be generated by the rotating fan 7. The sound-absorbing member 30 is disposed in the interior space of the housing 2 such that it faces the air-exhaust ports 10. Therefore, at least some of this noise is absorbed by the sound-absorbing member 30 as was described above, thereby reducing the noise output level of the handheld vacuum cleaner 1.

Effects and Advantages

As explained above, the sound-absorbing member 30 is disposed in the interior space of the housing 2 such that it faces the air-exhaust ports 10. The sound-absorbing member 30 is a porous member having open cells. As was explained with reference to FIG. 6, the sound-absorbing member 30 can absorb sound to reduce the noise output level of the handheld vacuum cleaner 1. In addition, the sound-absorbing member 30 has the at least one through hole 33 (33F). The air exhausted from the interior space to the exterior of the housing 2 passes through the through hole(s) 33 (33F) with less resistance than the porous material itself. Owing to the sound-absorbing member 30 having the through hole(s) 33 (33F) therein, an advantageous balance between noise reduction and smooth exhaust air flow can be achieved. Moreover, because the exhaust air flows smoothly out of the housing 2, the suction force of the handheld vacuum cleaner 1 at the suction port 3 is not reduced.

In embodiments, in which a plurality of the through holes 33 is provided in the sound-absorbing member 30, the air flows smoothly through the through holes 33 of the sound-absorbing member 30. In addition, by providing a plurality of the through holes 33, the surface area of the sound-absorbing member 30 may be increased, thereby increasing the sound-absorbing effect of the sound-absorbing member 30.

In embodiments, in which the through holes 33 are substantially parallel to one another, the exhaust air can flow smoothly through the through holes 33.

The sound-absorbing member 30 is preferably disposed such that at least a portion of the first opening 35 on one end of each through hole 33 faces the air-exhaust ports 10, and so that the second opening 36 on the other end of each through hole 33 faces the center of the interior space of the housing 2. In such an embodiment, the air that flows into the through holes 33 via the second openings 36 is exhausted via the first openings 35, and then is smoothly exhausted to the exterior space of the housing 2 via the air-exhaust ports 10.

Each air-exhaust port 10 preferably has a slit shape that is elongated in the X-axis direction. In such an embodiment, foreign matter outside of the housing 2 is prevented from penetrating into the interior space of the housing 2 via the air-exhaust ports 10. Inner diameter D of each first opening 35 is larger than dimension W of each air-exhaust port 10 in the latitudinal direction. Thereby, the air that circulates through the through holes 33 and flows out via the first openings 35 is smoothly exhausted to the exterior space of the housing 2 via the air-exhaust ports 10.

A plurality of the air-exhaust ports 10 is preferably provided in the latitudinal direction of the air-exhaust ports 10. In such an embodiment, the air is smoothly exhausted via the plurality of air-exhaust ports 10. Inner diameter D of each first opening 35 is larger than spacing G of each air-exhaust port 10 in the latitudinal direction of the relevant air-exhaust port 10. Thereby, each first opening 35 overlaps at least a portion of the air-exhaust ports 10. That is, the first openings 35 are prevented from being plugged up by the inner surface of the housing 2 between the air-exhaust ports 10. Accordingly, the air that passes through the through holes 33 and flows out via the first openings 35 is smoothly exhausted to the exterior of the housing 2 via the air-exhaust ports 10.

A plurality of the through holes 33 is preferably provided in both the latitudinal direction and the longitudinal direction of the air-exhaust ports 10. In such an embodiment, the air in the interior space of the housing 2 passes through each of the through holes 33 and is then smoothly exhausted to the exterior of the housing 2 via the air-exhaust ports 10.

The sound-absorbing member 30 is preferably supported by the support members 38, which protrude from the inner surface of the housing 2. The support members 38 are preferably disposed in the through holes 33 (33A, 33B). In such an embodiment, when the support members 38 are respectively inserted into the through holes 33 (33A, 33B), the sound-absorbing member 30 is mounted on the housing 2 in a simple manner. Accordingly, the labor for mounting the sound-absorbing member 30 on the housing 2, or for removing the sound-absorbing member 30 from the housing 2, is minimized.

Each support member 38 preferably comprises: the rod portion 38A, which is fixed to the inner surface of the housing 2; and the hook portion 38B, which is disposed on the tip of the rod portion 38A. In such an embodiment, when the support member(s) 38 is (are respectively) inserted into the through hole(s) 33A, the hook portion 38B is hooked to the second surface 32 of the sound-absorbing member 30. Thereby, the support member 38 is stably mounted onto the housing 2.

Preferably, the motor 8 is fixed to the motor base 16 and is fixed to the rear housing 22 via the fan cover 17. In such an embodiment, the rubber vibration isolator 18 may cover at least a portion of the fan cover 17, thereby inhibiting (blocking) vibration generated by the motor 8 from being transmitted to the rear housing 22.

The rubber vibration isolator 18 preferably comprises the protruding portion 182, which is disposed such that it surrounds the circular-tube portion 173 of the fan cover 17. In such an embodiment, dimension T of the protruding portion 182 is preferably larger than thickness U of the covering portion 181, which has the effect of reducing the transmission of vibration. In addition, noise is reduced by the protruding portion 182.

The grooves 183 are preferably provided in the front-end surface of the protruding portion 182. Owing to the grooves 183, the protruding portion 182 can bend sufficiently. Thereby, the transmission of vibration is reduced and thereby noise is reduced.

The interior space of the housing 2 is preferably partitioned by the partition wall 60 into: the first space SP1, in which the drive unit 40 comprising the fan 7 and the motor 8 is disposed; and the second space SP2, in which the trigger switch 13 is disposed. The partition wall 60 is preferably provided on both the left housing 22L and the right housing 22R. The portion of partition wall 60 that is provided on one of the left housing 22L and the right housing 22R includes the recess 63, in which the electrical cable 53 is disposed. The portion of the partition wall 60 provided on the other of the left housing 22L and the right housing 22R comprises the protruding portion that, when the left housing 22L and the right housing 22R are connected, presses and flattens the electrical cable 53, which is disposed in the recess 63. Thereby, when the electrical cable 53 is disposed in the interior space of the housing 2, the first space SP1 and the second space SP2 are partitioned thereby. The tube 53B of the cable 53 is an elastic or bendable member that, by virtue of being pressed and flattened by the protruding portion, seals the boundary between the first space SP1 and the second space SP2. Thereby, when the fan 7 rotates, the air in the first space SP1 is blocked from circulating to the second space SP2. The trigger switch 13 is provided in the second space SP2. A gap is provided between the trigger switch 13 and the handle 12 (the rear housing 22). Therefore, when the fan 7 rotates, because the boundary between the first space SP1 and the second space SP2 is sealed, air is prevented from circulating in the gap between the trigger switch 13 and the handle 12, thereby improving the ergonomics of the handheld vacuum cleaner 1. In addition, because the air in the first space SP1 is prevented from leaking into the second space SP2, failures or the like of the handheld vacuum cleaner 1 due to dust, debris, etc. are reduced.

In embodiments in which the rotation-preventing mechanism 90, which comprises the first protruding portion 91 and the second protruding portion 92, is provided, relative rotation between the front housing 21 and the rear housing 22 is blocked.

The motor 8 is preferably driven by the electric power supplied from a battery 5 for a power tool, which is mounted on the battery-mounting part 6. Thereby, because a power cord for connection to a commercial power supply (AC power supply) may be omitted, cleaning work can be performed without being hindered by such a power cord.

Second Embodiment

In the embodiment described above, the sound-absorbing member 30 is provided in the handheld vacuum cleaner 1. However, in another embodiment of the present teachings, the sound-absorbing member 30 may be provided in a canister vacuum cleaner or dust extractor that comprises castors for rolling on the floor.

Figure 22:
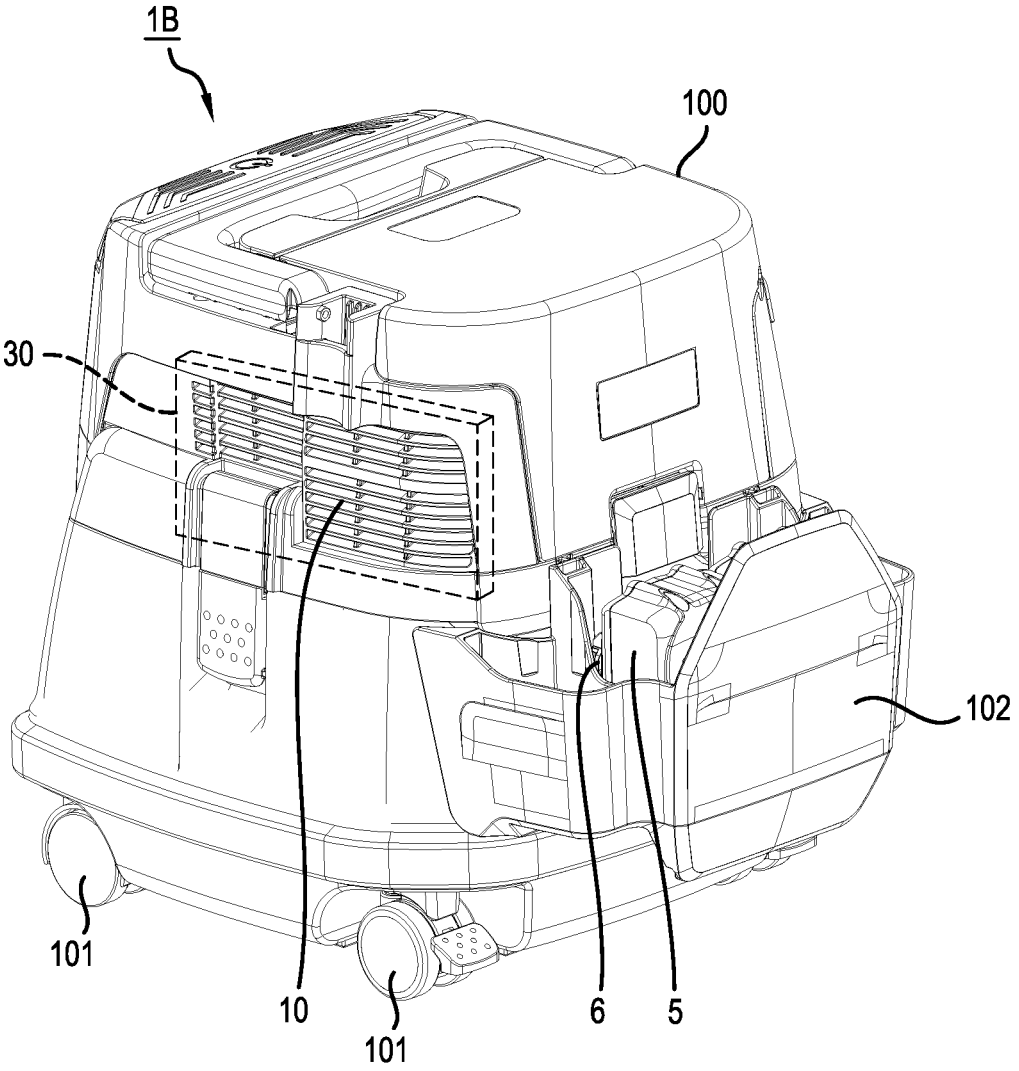
FIG. 22 shows a dust collector according to a second embodiment of the present teachings, which may be a drum or canister vacuum cleaner that rolls on four castors.

FIG. 22 is a drawing that shows a dust extractor/vacuum 1B of a second embodiment of a vacuum cleaner according to the present teachings. The dust extractor/vacuum 1B comprises: a housing 100, which houses the drive unit that comprises the fan and the motor; and castors 101, which movably support the housing 100 on a floor. The motor is driven by the electric current (power) supplied from one or more batteries 5 mounted on a battery-mounting part. The batteries 5 may be stored in a tool box 102, which is connected to the housing 100. The air-exhaust ports 10 are provided in the housing 100. The sound-absorbing member 30, which was explained in the embodiment described above, is disposed in the interior space of the housing 100. In the dust extractor/vacuum 1B shown in FIG. 22, the noise output level also may be reduced by the sound-absorbing member 30.

Additional aspects of the present teachings include, but are not limited to:

1. A vacuum cleaner comprising:

a housing that houses a fan and a motor, which generates power that rotates the fan;

an air-exhaust port or air-exhaust port(s), which is (are) provided in at least a portion of the housing; and a sound-absorbing member having a through hole disposed in an interior space of the housing so as to face the air-exhaust port(s).

2. The vacuum cleaner according to the above aspect 1, wherein the sound-absorbing member is a porous member having open cells.

3. The vacuum cleaner according to the above aspect 1 or 2, wherein a plurality of the through holes is provided in the sound-absorbing member.

4. The vacuum cleaner according to the above aspect 3, wherein the plurality of through holes are substantially parallel to one another.

5. The vacuum cleaner according to any one of the above aspects 1-4, wherein the sound-absorbing member is disposed such that at least a portion of a first opening on one end of each through hole faces the air-exhaust port(s), and a second opening at the other end of each through hole faces the interior space.

6. The vacuum cleaner according to the above aspect 5, wherein:

the air-exhaust port(s) is (are) elongated; and the first opening is larger than the dimension of the air-exhaust port in the latitudinal direction.

7. The vacuum cleaner according to the above aspect 6, wherein:

a plurality of the air-exhaust ports is provided in the latitudinal direction of the air-exhaust ports; and the first opening is larger than a spacing between the air-exhaust ports in the latitudinal direction.

8. The vacuum cleaner according to the above aspect 6 or 7, wherein a plurality of the through holes is provided in both the latitudinal direction and the longitudinal direction of the air-exhaust ports.

9. The vacuum cleaner according to any one of the above aspects 1-8, comprising a support member or support members, which protrude(s) from an inner surface of the housing and is (are) disposed in the through hole(s).

10. The vacuum cleaner according to the above aspect 9, wherein the support member(s) comprise(s) a rod portion, which is fixed to the inner surface of the housing, and a hook portion, which is disposed at a tip of the rod portion.

11. The vacuum cleaner according to any one of the above aspects 1-10, comprising:

a motor base, which supports the motor;

a fan cover, which is disposed around the fan and the motor base; and a rubber vibration isolator, which covers at least a portion of the fan cover.

12. The vacuum cleaner according to the above aspect 11, wherein:

the fan cover comprises a front-plate portion, which has a suction port, and a circular-tube portion, which is disposed around the suction port and protrudes forward from the front-plate portion; and the rubber vibration isolator comprises a protruding portion, which is disposed such that it surrounds the circular-tube portion.

13. The vacuum cleaner according to the above aspect 12, having a groove, which is provided in a front-end surface of the protruding portion.

14. The vacuum cleaner according to any one of the above aspects 1-13, comprising:

a battery-mounting part, on which a battery for a power tool is mounted;

wherein the motor is driven by electric power supplied from the battery.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved vacuum cleaners and methods of manufacturing and using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Handheld vacuum cleaner
1B Dust Extractor/Vacuum
2 Housing
3 Suction port
5 Battery
6 Battery-mounting part
7 Fan
8 Motor
10 Air-exhaust port
11 Opening
12 Handle
13 Trigger switch
14 Resin (plastic) rib
15 Filter

16 Motor base
17 Fan cover
18 Rubber vibration isolator
19 Screw
21 Front housing
22 Rear housing
22L Left housing
22R Right housing
22T Tube portion
30 Sound-absorbing member
31 First surface
32 Second surface
33 Through hole
33A Through hole
33B Through hole
33F Through hole
34 Cells
35 First opening
36 Second opening
38 Support member
38A Rod portion
38B Hook portion
40 Drive unit
51 Switching device
52 Control circuit board
53 Electrical cable
53A Lead wire
53B Tube
60 Partition wall
61 First partition wall
62 Second partition wall
62L Left partition wall
62R Right partition wall
63 Recess
71A Front plate
71B Rear plate
72 Blade
73 Suction port
74 Blow-out port
75 Insertion hole
81 Output shaft
82 Bearing
83 Screw hole
84 Body
90 Rotation-preventing mechanism
91 First protruding portion
92 Second protruding portion
100 Housing
101 Castor
102 Tool box
161 Baseplate
162 Baffle
162A Inner side wall
162B Tilted portion
162C Outer side wall
162D Stop
163 Insertion hole
164 Projection
165 Hole
166 Fixing rib
171 Suction port
172 Front-plate portion
173 Circular-tube portion
174 Outer-tube portion
175 Projection
176 Circular-tube portion
177 Rib
178 Projection
179 Hole
181 Covering portion
182 Protruding portion
182R Rib
183 Groove
184 Coupling rib
185 Recess
300 Sound-absorbing member
AX Rotary shaft
CX Central axis
DX Central axis
LX Centerline

We claim:

1. A vacuum cleaner comprising:

a housing that houses a fan and a motor, which generates power that rotates the fan;

a plurality of air-exhaust ports provided in at least a portion of the housing, the air-exhaust ports being elongated in a first direction and arranged in parallel in a second direction that is perpendicular to the first direction; and a sound-absorbing member having a plurality of through holes, the sound-absorbing member being disposed in an interior space of the housing so as to face and press against the air-exhaust ports;

wherein:

the sound-absorbing member is disposed such that at least a portion of a first opening at a first end of each of the through holes faces the air-exhaust ports, and a second opening at the other end of each of the through holes faces the interior space;

a widest dimension of the through holes is within a range of 1-20 mm;

a minimum distance between edges of adjacent ones of the through holes is within a range of 1-25 mm; and the first openings each have a dimension in the second direction that is larger than a spacing between the air-exhaust ports in the second direction.

2. The vacuum cleaner according to claim 1, wherein the sound-absorbing member is a porous member having open cells.

3. The vacuum cleaner according to claim 1, further comprising:

a battery-mounting part defined on the housing; and a battery for a power tool mounted on the battery-mounting part;

wherein the motor is driven by electric power supplied from the battery.

4. The vacuum cleaner according to claim 1, wherein:

the dimension of the first opening in the second direction also is larger than a largest dimension of the elongated air-exhaust ports in the second direction.

5. The vacuum cleaner according to claim 4, wherein the plurality of the through holes is provided in both the first and second directions of the air-exhaust ports.

6. The vacuum cleaner according to claim 5, further comprising at least one support member that protrudes from an inner surface of the housing and is disposed in at least one of the plurality of the through holes.

7. The vacuum cleaner according to claim 1, wherein the sound-absorbing member has a thickness in a direction perpendicular to a first surface of the sound-absorbing member of 5-30 mm.

8. The vacuum cleaner according to claim 7, wherein the sound-absorbing member exhibits a sound-absorbing coefficient at 1,000 Hz of 0.3 or more, and at 2,000 Hz of 0.6 or more.

9. The vacuum cleaner according to claim 8, wherein a ratio of a surface area of the through holes in the first surface of the sound-absorbing member to a total area of the first surface of the sound-absorbing member is between 0.01-0.30.

10. The vacuum cleaner according to claim 1, wherein the through holes extend at least substantially parallel to one another.

11. The vacuum cleaner according to claim 10, wherein:

the dimension of each of the first openings of the through holes in the second direction that is larger than a largest dimension of the elongated air-exhaust ports in the second direction.

12. The vacuum cleaner according to claim 11, wherein the through holes are arrayed in both the first and second directions.

13. The vacuum cleaner according to claim 12, further comprising at least one support member that protrudes from an inner surface of the housing and is disposed in at least one of the plurality of the through holes.

14. The vacuum cleaner according to claim 13, further comprising:

a battery-mounting part defined on the housing; and a battery for a power tool mounted on the battery-mounting part, wherein the motor is driven by electric power supplied from the battery.

15. The vacuum cleaner according to claim 14, wherein:

a ratio of a surface area of the through holes in a first surface of the sound-absorbing member to a total area of the first surface of the sound-absorbing member is between 0.01-0.30;

the sound-absorbing member has a thickness in a direction perpendicular to the first surface of the sound-absorbing member of 5-30 mm; and the sound-absorbing member exhibits a sound-absorbing coefficient at 1,000 Hz of 0.3 or more, and at 2,000 Hz of 0.6 or more.

16. The vacuum cleaner according to claim 15, wherein:

the sound-absorbing member is made of a polymer foam or sponge material having a porosity of 0.50-0.95; and cells of the polymer foam or sponge material have a greatest pore dimension of 50-500 μm.

17. A vacuum cleaner comprising:

a housing;

a fan and a motor disposed in the housing, the motor being configured to rotate the fan to generate a suction force that draws air into the housing;

a plurality of air-exhaust ports defined in a portion of the housing, the air-exhaust ports being elongated in a first direction and arranged in parallel in a second direction that is perpendicular to the first direction;

a sound-absorbing member having a plurality of through holes that extend at least substantially parallel to one another in a third direction that is perpendicular to both the first and second directions, the sound-absorbing member being disposed in an exhaust air flow path within the housing and adjacent to the air-exhaust ports;

a battery-mounting part defined on the housing; and a battery for a power tool mounted on the battery-mounting part, the motor being driven by electric power supplied from the battery;

wherein the sound-absorbing member is a porous member having open cells;

the through holes each have a widest dimension of 1-20 millimeters;

a ratio of a surface area of the through holes in a first surface of the sound-absorbing member to a total area of the first surface of the sound-absorbing member is between 0.01-0.30;

a minimum distance between edges of adjacent ones of the through holes is 1-25 mm;

the sound-absorbing member has a thickness in a direction perpendicular to the first surface of the sound-absorbing material of 5-30 mm; and the sound-absorbing member exhibits a sound-absorbing coefficient at 1,000 Hz of 0.3 or more, and at 2,000 Hz of 0.6 or more.

18. The vacuum cleaner according to claim 17, wherein:

the sound-absorbing member is made of a polymer foam or sponge material having a porosity of 0.50-0.95; and cells of the polymer foam or sponge material have a greatest pore dimension of 50-500 μm.

19. The vacuum cleaner according to claim 17, wherein the through holes each have an opening dimension in the second direction that is larger than a dimension of the air-exhaust ports in the second direction and a spacing between the air-exhaust ports in the second direction.

20. The vacuum cleaner according to claim 19, wherein:

the sound-absorbing member is made of a polymer foam or sponge material having a porosity of 0.50-0.95; and cells of the polymer foam or sponge material have a greatest pore dimension of 50-500 μm.

* * * * *